US007464928B2

(12) United States Patent
Ko

(10) Patent No.: US 7,464,928 B2
(45) Date of Patent: Dec. 16, 2008

(54) MEDIA DISCHARGING UNIT FOR MEDIA DISPENSER

(75) Inventor: Kyung-Ho Ko, Pyeongtaek (KR)

(73) Assignee: LG N-SYS Inc., Seoul (KR)

( * ) Notice: Subject to any disclaimer, the term of this patent is extended or adjusted under 35 U.S.C. 154(b) by 457 days.

(21) Appl. No.: 11/017,832

(22) Filed: Dec. 22, 2004

(65) Prior Publication Data

US 2005/0189693 A1 Sep. 1, 2005

(30) Foreign Application Priority Data

Dec. 27, 2003 (KR) ..... 10-2003-0098249

(51) Int. Cl.
*B65H 29/00* (2006.01)

(52) U.S. Cl. ..... 271/187; 271/220; 271/315

(58) Field of Classification Search ..... 271/149, 271/184–187, 220, 177–181, 315; 902/14–17; 109/24.1, 45; 414/790.2, 789.9; 53/447; 294/103.1, 119.1; 269/154
See application file for complete search history.

(56) References Cited

U.S. PATENT DOCUMENTS 2,799,939 A * 7/1957 Bivans ..... 33/501
3,286,744 A * 11/1966 Stall et al. ..... 83/409
3,310,302 A * 3/1967 Catalfimo ..... 269/154
3,930,582 A 1/1976 Gartner et al.
4,439,083 A 3/1984 Jenkins et al.
4,462,509 A 7/1984 Adelberger
4,470,590 A 9/1984 Ariga et al.
4,498,381 A 2/1985 Convey, Jr.
4,511,301 A 4/1985 Kawano et al.
4,593,895 A 6/1986 Myers et al.
4,602,332 A 7/1986 Hirose et al.
4,699,272 A 10/1987 Kokubo et al.
4,729,556 A 3/1988 Fujii et al.
4,854,452 A 8/1989 Uchida et al.
4,883,181 A 11/1989 Yoshikawa
4,937,460 A 6/1990 Duncan et al.
4,958,827 A 9/1990 Kaneko
4,971,514 A 11/1990 Hunter
5,106,077 A 4/1992 Kawaguchi et al.
5,518,230 A 5/1996 Scarlata et al.

(Continued)

FOREIGN PATENT DOCUMENTS

DE 40 09 139 C1 9/1991

(Continued)

*Primary Examiner*—Patrick H Mackey
*Assistant Examiner*—Jeremy Severson
(74) *Attorney, Agent, or Firm*—Birch, Stewart, Kolasch & Birch, LLP

(57) ABSTRACT

The present invention relates to media discharging unit for a media dispenser. The present invention includes a delivery module, which selectively feeds media fed from a media box to a discharge position and a reject position one-by-one using belts and rollers. A stacking module is separable from the delivery module, and collects the media, which are fed by the delivery module, one-by-one upon the rotation of a stacking wheel and then feeds the collected media as a stack at one time. A stack delivery module is separable from the stacking module, and clamps the stacked media, which are collected in the stacking module, and feeds the stacked media to a position where a customer can take the media.

20 Claims, 27 Drawing Sheets

U.S. PATENT DOCUMENTS

| | | | | |
|---|---|---|---|---|
| 5,971,392 | A | 10/1999 | Lee | |
| 6,276,678 | B1 | 8/2001 | Nottelmann et al. | |
| 6,819,906 | B1 | 11/2004 | Herrmann et al. | |
| 2002/0011431 | A1 * | 1/2002 | Graef et al. | 209/534 |
| 2003/0071408 | A1 | 4/2003 | Quadalti | |
| 2003/0116724 | A1 | 6/2003 | Kim | |

FOREIGN PATENT DOCUMENTS

| | | | |
|---|---|---|---|
| EP | 0 356 150 | B1 | 2/1990 |
| EP | 0 499 458 | A3 | 8/1992 |
| EP | 1 096 434 | A3 | 5/2001 |
| EP | 1 153 870 | A3 | 11/2001 |
| JP | 02100963 | A * | 4/1990 |
| JP | 3-276281 | A | 12/1991 |
| KP | 1991-0010526 | | 7/1991 |
| WO | WO-01/22314 | A1 | 3/2001 |

* cited by examiner

MEDIA DISCHARGING UNIT FOR MEDIA DISPENSER

This application claims the priority benefit of Patent Application No. 2003-10-098249 filed on Dec. 27, 2003 in Korea, which is hereby incorporated by reference.

BACKGROUND OF THE INVENTION

1. Field of Invention

The present invention relates to a media dispenser, and more particularly, to a media discharging unit for a media dispenser to take out a customer's desired number of media from a media box and to feed them to the customer.

2. Description of the Prior Art

FIG. 1 shows the construction of a related art media dispenser. According to the figure, various components for feeding media are provided between two guide plates 200 with a predetermined spacing. The front surface of the media dispenser corresponding to an end of the guide plates 200 is provided with a door 202 for selectively opening or closing a predetermined space formed between the guide plates 200. The door 202 is installed at a side of the guide plates 200 so as to be opened or closed about a hinge. Reference numeral 204 designates a locking member for maintaining the door 202 closed.

A reject box 206 for collecting abnormal media is mounted in the space between the guide plates 200 and is selectively opened and closed by the door 202. A media box 208 is mounted below a position, where the reject box 206 is mounted, in the space selectively opened and closed by the door 202. The media to be supplied from the media dispenser is put in the media box 208. The reject box 206 and the media box 208 are detachable with the door 202 opened.

The guide plates 200 are provided with various components for feeding the media. First, a driving motor 210 providing a driving force for feeding the media is installed at a side of the guide plates 200. In order to separate the media in the media box 208 and dispense them one-by-one, a pickup roller 212 is installed at a position corresponding to the front end of the media box 208.

A feeding path 214 for feeding the media is formed between the guide plates 200 as indicated with an arrow. The feeding path 214 is composed of a plurality of rollers 216 and belts 218. A diverter 220 for rejecting the abnormal media to the reject box 206 is provided on the feeding path 214. In addition, a discharge part 230 is provided in the upper end of the front surface of the media dispenser, i.e., the end portion of the feeding path 214. Such a media dispenser is installed in a cabinet forming the appearance thereof for use.

However, such a related art has some drawbacks. First, in the related art, the components forming the media feeding path 214, the reject box 206, the media box 208 and the like are provided between the guide plates 200. Therefore, if the media are jammed on the feeding path 214, it is very difficult to remove them. In particular, if the components forming the feeding path 214, especially those components between the guide plates 200, are damaged, it is very difficult to repair them.

Furthermore, since the constructions of the related art is so designed that the discharge part 230 is provided in a side of the guide plates 200, it is a drawback that the entire construction provided in the guide plates 200 would have to be redesigned in order to change the direction of the discharge part.

In addition, when several sheets of the media are provided to a customer in the related art, the media sheets freely fall at a position where the customer takes them out and are stacked up. Thus, sheets of the media are not closely stacked and become large in volume, so that it is very inconvenient for the customer taking them by hand.

Furthermore, when the customer does not take the media, a reject box for retrieving the media should be adjacent to the position where the customer takes out the media. Thus, that is also a drawback since there is no way to retrieve the media, once provided to the customer, into the media dispenser if the customer fails to take the dispensed media.

SUMMARY OF THE INVENTION

Therefore, the present invention is conceived to solve one or more of the aforementioned drawbacks in the related art. An object of the present invention is to provide a media discharging unit for a media dispenser wherein access to the components provided therein is easy.

Another object of the present invention is to provide a media discharging unit for a media dispenser wherein a position for feeding media to a customer can be set freely.

A further object of the present invention is to make delivered media compact when several sheets of the media are provided to a customer.

A still further object of the present invention is to provide a media discharging unit for a media dispenser, which can feed several sheets of media at a time.

A still further object of the present invention is to improve an operational reliability for feeding multiple sheets of media at a time.

A still further object of the present invention is to provide a media discharging unit for a media dispenser, which can precisely sense the thickness of media and be used for various media.

A still further object of the present invention is to freely design the constitution for rejecting media.

According to an aspect of the present invention for achieving one or more of the above objects, a media discharging unit for a media dispenser is provided, comprising a delivery module, which selectively feeds media fed from a media box to a discharge position or a reject position one-by-one using belts and rollers; a stacking module separable from the delivery module for collecting the media, which are fed for discharge by the delivery module, one-by-one upon the rotation of a stacking wheel and then feeding the collected media all at a time; and a stacking delivery module separable from the stacking module for clamping the media, which are collected in the stacking module and fed therefrom, and feeding the media all at a time to a position where a customer can take the media.

The stacking module may be provided between two first guide plates, which are positioned in parallel with a predetermined spacing from each other. The delivery module may be provided between two second guide plates, which are engaged with the first guide plates by screws, respectively, and positioned in parallel with a predetermined spacing from each other. The stacking delivery module, which is engaged with the first guide plates by screws, may be provided in a tray frame, which is installed elongately along a side of the respective first guide plates.

Mounting flanges may be formed on both sides of the tray frame in a width direction. Upper end flanges for mounting to the mounting flanges may be formed at the upper ends of each of the first guide plates, respectively. The upper end flanges and the mounting flanges are engaged with each other. An engaging hole for mounting to the upper end flange may be formed in a circular shape in the longitudinally center of each of the mounting flanges. Engaging holes may be formed in an elongate hole shape at both sides of the circular engaging hole in the longitudinal direction of the mounting flanges.

A mechanism for sensing the thickness of media may be provided on a portion of a feeding path for the media in the delivery module. Pairs of a sensing roller and a sensing bearing may be provided at positions corresponding to at least two portions of the media, so that the thickness of the media is sensed at the at least two portions of the media at the same time by passing the media between the sensing rollers and the sensing bearings.

The mechanism for sensing thickness of media may comprise a sensing frame, in which at least two chambers, each of which has a bearing window, are formed. The sensing rollers are rotatably installed at positions corresponding to the chambers on a sensing roller shaft connected to both ends of the sensing frame. Bearing holders, each of which is subjected to an elastic force rotate about a rotational center in the direction of the sensing roller in each of the chambers. The sensing bearings, each of which is freely rotatably provided in the corresponding bearing holders and contacts with the corresponding sensing rollers; shielding plates, each of which is integrally provided in the corresponding bearing holders; and sensors, each of which is provided in the corresponding sensing frame and includes a light emitting portion and a light receiving portion. A light emitted from the light emitting portion is controlled in its amount by the shielding plate and transferred to the light receiving portion.

The light emitting portion and the light receiving portion of the sensor may be provided at both ends of each of the chambers; the shielding plate may be positioned between the light emitting portion and the light receiving portion; and the light from the light emitting portion may be transferred to the light receiving portion through two windows, which are selectively screened by the shielding plate.

The stacking module may include the stacking wheel, which is provided on rotational shaft, both ends of which are supported in the first guide plates, is formed with a plurality of tangential wings in the tangentialial direction, and feeds the media with the media inserted between the tangentialial wings; a stacker, which is provided with a stacking plate on which a side of the media fed by the stacking wheel is rested; and a clamping mechanism, which clamps numbers of the media rested on the stacker and feeds them to the stacking delivery module.

The stacker may be selectively positioned between a horizontal state and a non-horizontal state of the stacking plate by a separate driving source.

The clamping mechanism may include a clamp housing; at least two clamp arms, which may be projected out of or received into both ends of the front surface of the clamp housing, respectively, the front ends of which are provided with clamping plates, respectively; and elastic plates, each of which is installed at a position corresponding to each of the clamping plates in the front surface of the clamp housing so as to be supported by an elastic member and project from the front surface of the clamp housing.

In order to drive the clamp arms, an arm driving motor may be provided in the clamp housing, and pinion gears may be provided at both ends of a gear shaft rotated by the arm driving motor and be engaged with rack portions formed on the clamp arms, respectively.

The rack portions may be formed at the upper end and the lower end of each of the clamp arms corresponding to each other, and the pinion gears engaged with the rack portions may be engaged with each other at both ends of the gear shafts, which are rotated by the driving force of the arm driving motor, respectively, and transfer the driving force.

The clamp housing may be rotatably installed about a housing driving shaft in a predetermined range of an angle between the first guide plates; and a mechanism for rotating the clamp housing may include a housing motor, which operates in one direction; a driving link, which is connected to a rotational shaft of the housing motor to rotate integrally therewith; a second connecting link, which is connected to the housing driving shaft to rotate integrally therewith; and a first connecting link, both ends of which are relatively rotatably connected to the driving link and the second connecting link by pins, respectively.

A damper plate may be installed between the elastic plates of the front surface of the clamp housing so that the front end of the damper plate is pivotable about a rotational center at an end of the damper plate by a predetermined angle, pushing the media erected on the stacker toward the stacking wheel.

The damper plate may be selectively positioned in a position where the damper plate closely contacts with the front surface of the clamp housing by a solenoid or in a position where the damper plate is inclined toward the stacking wheel.

The stacking delivery module may include a driving source; a timing belt, which transfers a driving force from the driving source; and a holder assembly, which is connected to the timing belt to move along a tray frame, clamps the media fed from the stacking module and then feeds the media to a position where a customer can take the media.

Two of the timing belts may be provided at both ends of the tray frame, respectively, so as to transfer the driving force to the holder assembly.

The holder assembly may include a holder tray, which is guided along side rails in both sides of the tray frame; an upper holder and a lower holder, which are installed on the holder tray so as to clamp the media adapted to be fed to the customer by an elastic force from an elastic member; and a holder motor, which provides a driving force causing ends of the upper holder and the lower holder to contact with or be separated from each other.

The holder motor may include a rotational shaft having a bushing cam where a cam portion of the bushing cam is formed to be projected in a radial direction about a rotational center; the bushing cam may selectively contact with any one of the upper holder and the lower holder according to the rotation of the holder motor; and the upper holder and the lower holder may be connected to each other by a connecting link so that they operate at the same time.

Data for operating the upper holder and the lower holder may be provided by sensing a detective piece provided in any one of the upper holder and the lower holder by a sensor.

Frictional members may be provided at the corresponding front ends of the upper holder and the lower holder, respectively, so that the media are securely clamped.

A feeding position of the holder assembly may be detected by sensing a detective piece by a plurality of sensors provided in the tray frame. The detective piece may be formed integrally with a belt holder, which connects the timing belt and the holder assembly.

The sensors for sensing the feeding position of the holder assembly may include sensors provided in an initial position and a final position of the holder assembly and a position where the media are fed from the stacking module, respectively.

The sensors for sensing the feeding position of the holder assembly may further include a sensor provided, before the final position, in a position for sensing a time for opening a door, through which the customer takes the media.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
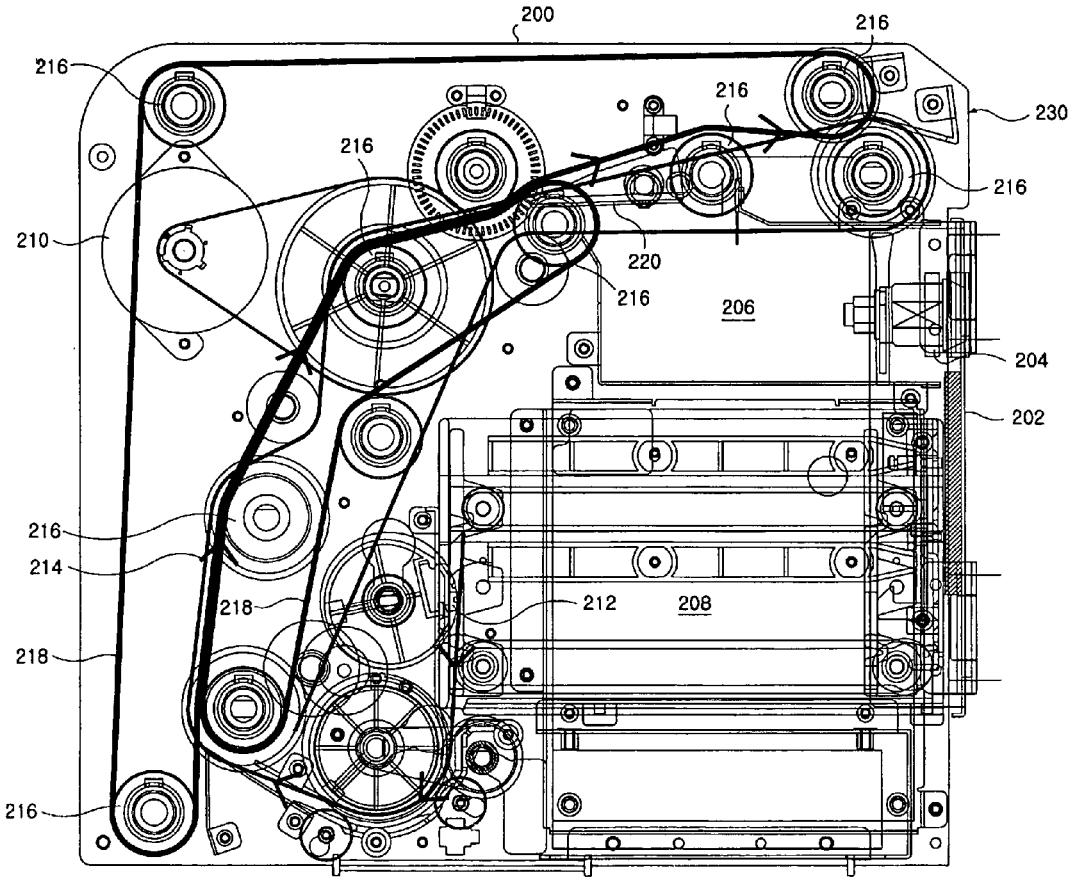
FIG. 1 Related Art
FIG. 1 is a side view showing the construction of a media dispenser according to the related art.
Figure 2:
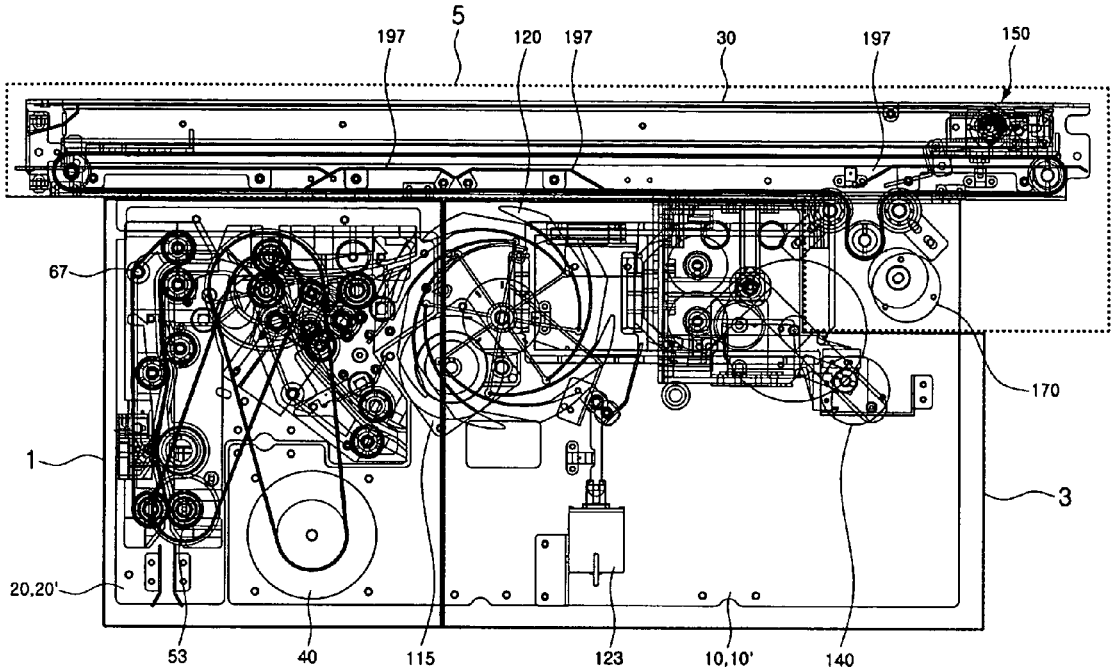
FIG. 2 is a view showing the construction of one embodiment of a media discharging unit for a media dispenser according to the present invention.

Referring to the accompanying drawings, a preferred embodiment of a media discharging unit for a media dispenser according to the present invention will be explained. FIG. 2 shows an entire construction of the embodiment of the present invention, wherein the present invention generally comprises a delivery module 1, a stacking module 3 and a stack delivery module 5. The delivery module 1 functions to separate sheets of media from a media box (not shown), in which the media are stored, one-by-one and feed them to a predetermined position. Upon feeding the media, the delivery module 1 also functions to separate the rejectable media from the dischargeable media by sensing the thickness of the media.

The stacking module 3 functions to collect desired sheets of the media fed from the delivery module 1 and then feed them in stack form to the stack delivery module 5. The stack delivery module 5 functions to feed the media fed from the stacking module 3 to a position where a customer may take out the media.

Figure 3A:
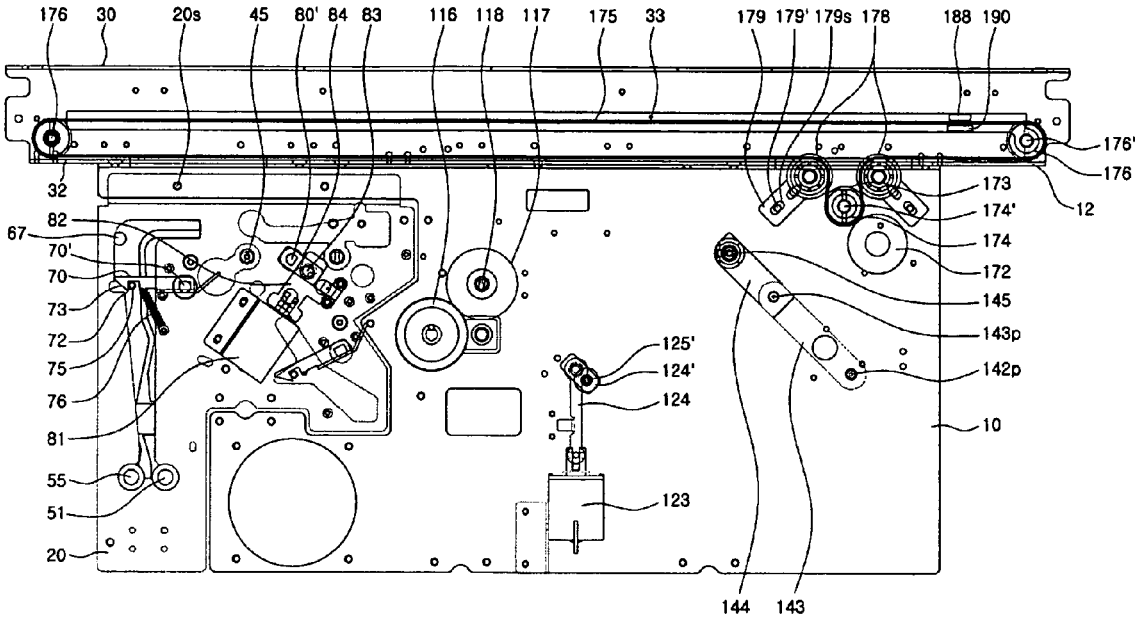
FIG. 3*a* is a side view showing the outer surface of a side of the first and second guide plates in the embodiment of the present invention.
Figure 3B:
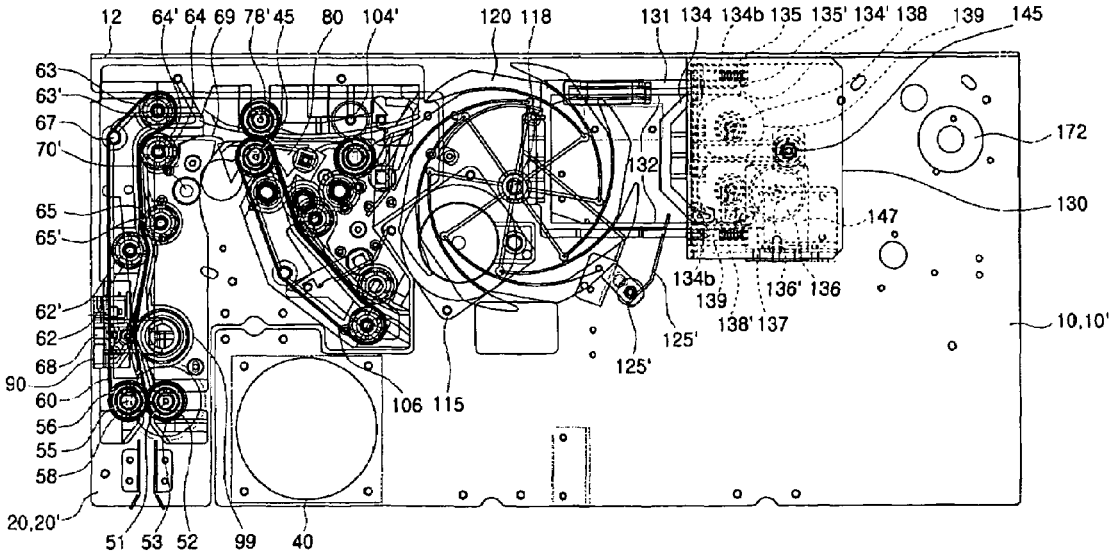
FIG. 3*b* is a sectional view showing features of the inner construction of one embodiment of the present invention.
Figure 3C:
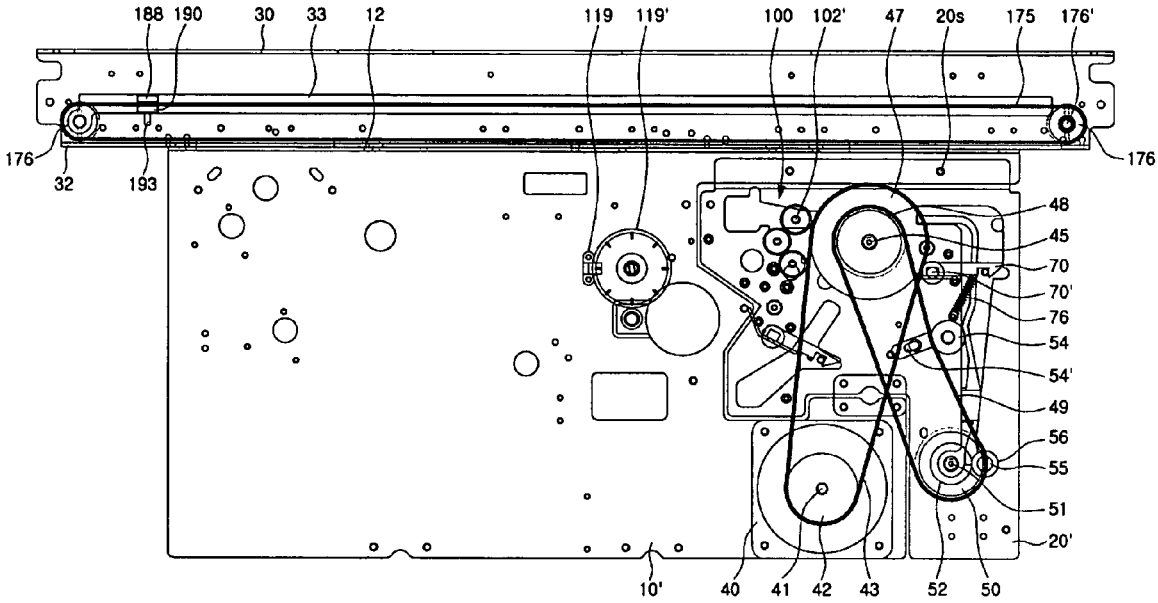
FIG. 3*c* is a side view showing the outer surface of the other side of the first and the second guide plates in the embodiment of the present invention.
Figure 3D:
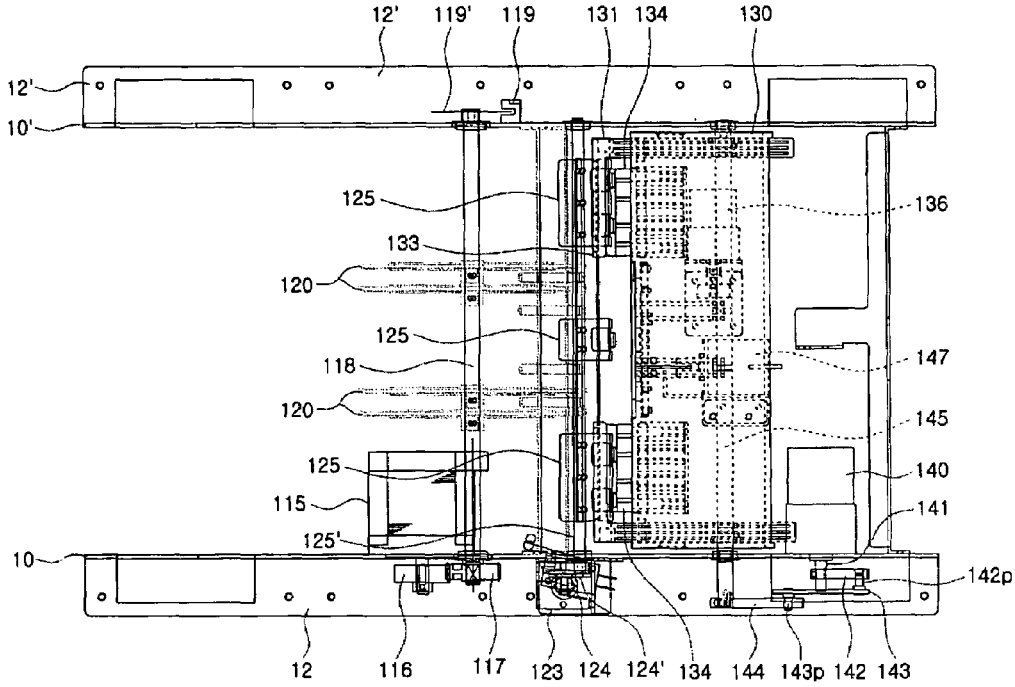
FIG. 3*d* is a plane view showing the construction between the first and second guide plates of the embodiment of the present invention.
Figure 3E:
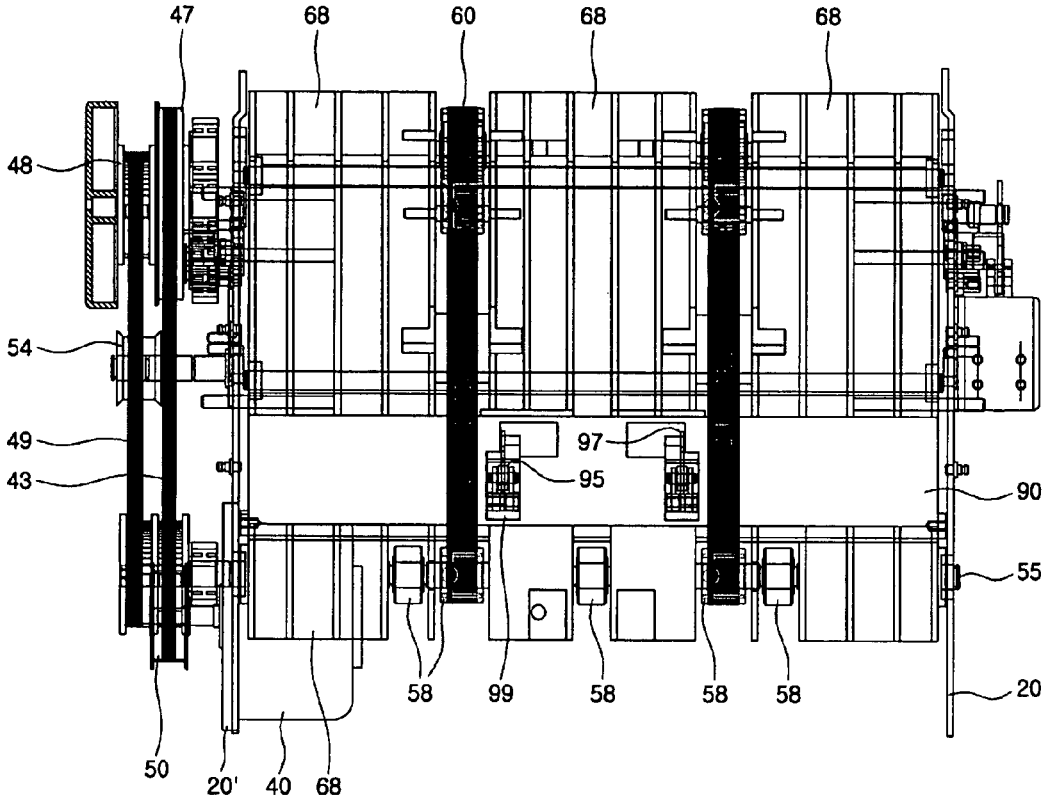
FIG. 3*e* is a front view showing the construction between the second guide plates of the embodiment of the present invention.
Figure 4:
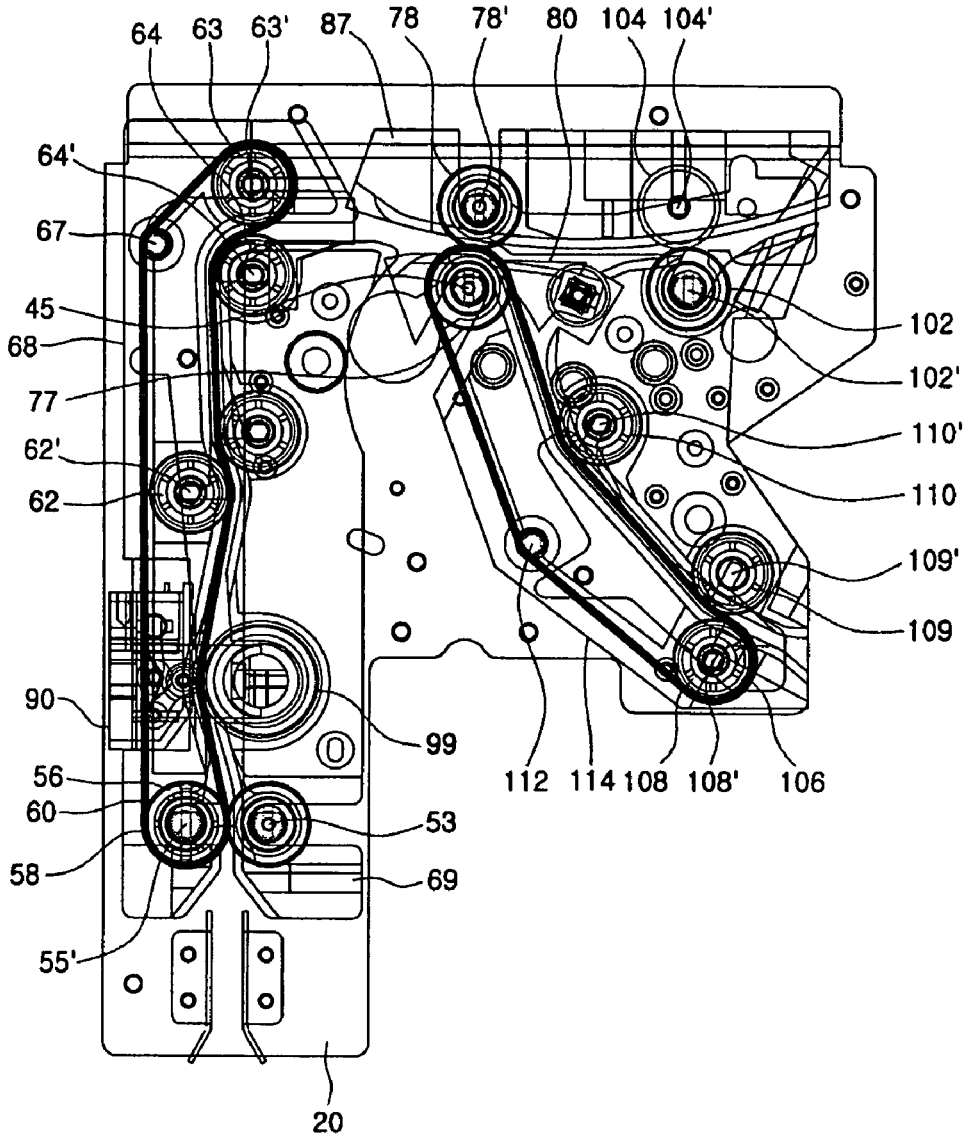
FIG. 4 is a view showing major portions of a delivery module in the embodiment of the present invention.

Referring to FIGS. 3*a* to 4, the construction of the delivery module 1 is explained in detail. According to FIG. 3*d*, first guide plates 10 and 10' are configured in parallel at a constant interval from each other. Each of the first guide plates 10 and 10' has a rectangular plate shape, wherein a portion of an end of each first guide plate 10 and 10' is cut out. Upper end flanges 12 and 12' are formed at the upper end of the first guide plates 10 and 10', wherein the upper end flanges 12 and 12' are generally vertically bent outward.

Second guide plates 20 and 20' are installed in the cutaway portions of the first guide plates 10 and 10', respectively. The second guide plates 20 and 20' and the first guide plates 10 and 10' partially overlap and are engaged by screws 20*s*. The portions where the first guide plates 10 and 10' and the second guide plates 20 and 20' do not overlap are connected to each other by using separate connecting plates (not shown).

A tray frame 30 is installed on the upper end flanges 12 and 12' of the first guide plates 10 and 10'. The tray frame 30 is a portion in which a holder assembly 150, which will be explained below, and a structure for moving the holder assembly 150 are mounted.

A driving motor 40 is installed in the first guide plate 10'. The driving motor 40 provides a driving force for feeding the media. A driving pulley 42 is installed on a rotational shaft 41 of the driving motor 40. A driving belt 43, e.g. a timing belt, is wound around the driving pulley 42.

A driven pulley 47, which rotates about a rotational shaft 45, both ends of which are supported by the second guide plates 20 and 20', is wound around another portion of the driving belt 43. The driven pulley 47 is provided in the second guide plate 20'. Therefore, a driving force of the driving motor 40 is transferred through the driving belt 43 to the driven pulley 47. The rotational shaft 45 is provided with a connecting pulley 48 coaxially with the driven pulley 47. The connecting pulley 48 rotates integrally with the rotational shaft 45. A connecting belt 49, e.g. another timing belt, is wound around the connecting pulley 48.

A driven pulley 50 is installed in the lower end of the second guide plate 20'. The driven pulley 50 is installed so as to rotate integrally with a rotational shaft 51, both ends of which are supported by the second guide plates 20 and 20'. A driving gear 52 is installed on the rotational shaft 51 where the driven pulley 50 is installed. The driving gear 52 rotates integrally with the driven pulley 50 by means of the rotational shaft 51. Rollers 53 are installed on the rotational shaft 51 at predetermined intervals between the second guide plates 20 and 20'.

A tension pulley 54 for controlling a tension of the connecting belt 49 is installed on the second guide plate 20' with the tension pulley 54 being mounted to a tension bracket 54'. The tension pulley 54 may control the tension of the connecting belt 49 according to the mounting position of the tension bracket 54'.

A rotational shaft 55 is installed so that both ends of the rotational shaft 55 are supported by the second guide plates 20 and 20'. The rotational shaft 55 is installed in parallel with the rotational shaft 51. A driven gear 56 is installed on the rotational shaft 55 so as to be engaged with the driving gear 52. The driving gear 52 and the driven gear 56 are installed outside the second guide plate 20'. Of course, the driving gear 52 and the driven gear 56 may be installed outside the second guide plate 20, so that the driving force may be transferred from the rotational shaft 51 to the rotational shaft 55.

A plurality of rollers 58 are installed on the rotational shaft 55 between the second guide plates 20 and 20'. Conveyer belts 60 are wound around some of the rollers 58. The rollers 58 and the conveyer belts 60 function to feed the media by directly contacting with the media. The rollers 58, around which the conveyer belts 60 are not wound, correspond to the rollers 53.

In the present embodiment, two conveyer belts 60 are installed at a constant interval. The conveyer belts 60 are wound around rollers 62, 63, 64 and 65, which are installed on roller shafts 62', 63', 64' and 65', respectively. Reference numeral 67 designates a guide shaft, around which other portions of the conveyer belts 60 are wound. It is preferable that the number of each of the rollers 62, 63, 64 and 65 is provided according to the number of the conveyer belts 60. Rollers, which directly contact with the media, may be separately installed on the roller shafts 62', 63', 64' and 65', on which rollers 62, 63, 64 and 65 are installed, respectively.

Figure 5:
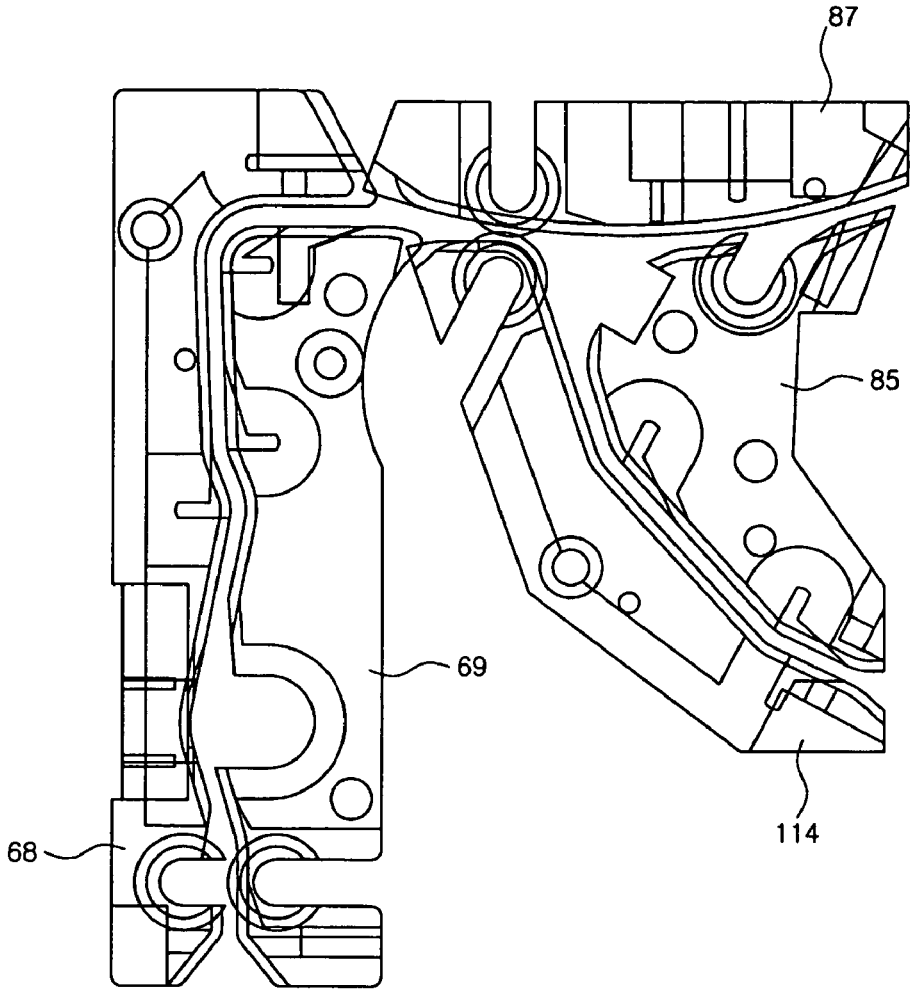
FIG. 5 is a side view showing the arrangement and construction of media guides provided in the delivery module of the embodiment of the present invention.

A plurality of media guides 68 and a plurality of media guides 69 are installed between the second guide plates 20 and 20', respectively, in order to guide the media fed by the conveyer belts 60. At least two of the media guides 68 and at least two of the media guides 69 are arranged in parallel with similar shapes, respectively. The configuration of the media guides 68 and 69 is well shown in FIG. 5. The media guides 68 and 69 are provided with portions having shapes for avoiding interferences with the rollers 63, 64 and 65.

The upper ends of the first media guides 68 may rotate about the rotational shaft 55, extending between the second guide plates 20 and 20', at a predetermined angle. On the rotational shaft 55, the rollers 58 alternate with the first media guides 68. Both ends of the roller shafts 62' and 63' and the guide shaft 67 are supported by the first media guides 68.

The second media guides 69 are installed with a predetermined spacing from the first media guides 68. A plurality of the second media guides 69 may be installed between the second guide plates 20 and 20'. The number of the first media guides 68 and the second media guides 69 correspond to each other e.g. are equal.

The plurality of the first media guides 68 and the roller shafts 62' and 63' and the like installed thereon are in the form of an assembly as a whole so that they pivot about the rotational shaft 55. In addition, when a jam occurs upon feeding the media, in order to remove the jam, the assembly including the first media guides 68 is formed so that the assembly may be spaced apart from the second media guides 69. That is, the assembly including the first media guides 68 rotates about the rotational shaft 55 so as to be moved away from the second guide plates 20 and 20'.

In order to hold the first media guides 68 and the second media guides 69 spaced from each other during use, the assemblies are engaged with each other by lockers 70. The lockers 70 are installed on a locker shaft 70', both ends of which are rotatably supported by the second guide plates 20 and 20'. The lockers 70 are provided at the outer sides of the second guide plates 20 and 20', respectively. Each of the lockers 70 is provided with a latching groove 72, and a guide surface 73 is formed at the front end of the locker 70. The assembly including the first media guides 68 is provided with locker pins 75 on which the lockers 70 are hooked. The locker 70 is subjected to an elastic force by a spring 76 in the direction where the locker 70 is hooked at the locker pin 75.

A plurality of rollers 77 are also installed on the rotational shaft 45 between the second guide plates 20 and 20'. The rollers 77 rotate upon the rotation of the rotational shaft 45, so that the rollers 77 feed the media. The rollers 77 are divided into ones, which directly contact with the media, and others, around which reject belts 106 are wound, which will be explained below.

A plurality of rollers 78 are provided, the number of which corresponds to that of the rollers 77 installed on the rotational shaft 45 between the second guide plates 20 and 20'. The rollers 78 are installed on the rotational shaft 78', both ends of which are supported by fourth media guides 87, which will be explained below. The rollers 78 are installed at positions corresponding to the rollers 77, around which the reject belts 106 are not wound. The rollers 78 closely contact with the rollers 77 installed on the rotational shaft 45, and may rotate therewith.

A diverter 80 is provided in a portion of a moving path of the media, passing between the rollers 77 and the rollers 78. The diverter 80 causes the media to be normally discharged or to be rejected. The diverter 80 is driven by a solenoid 81 provided in the outer surface of the second guide plate 20.

Figure 6:
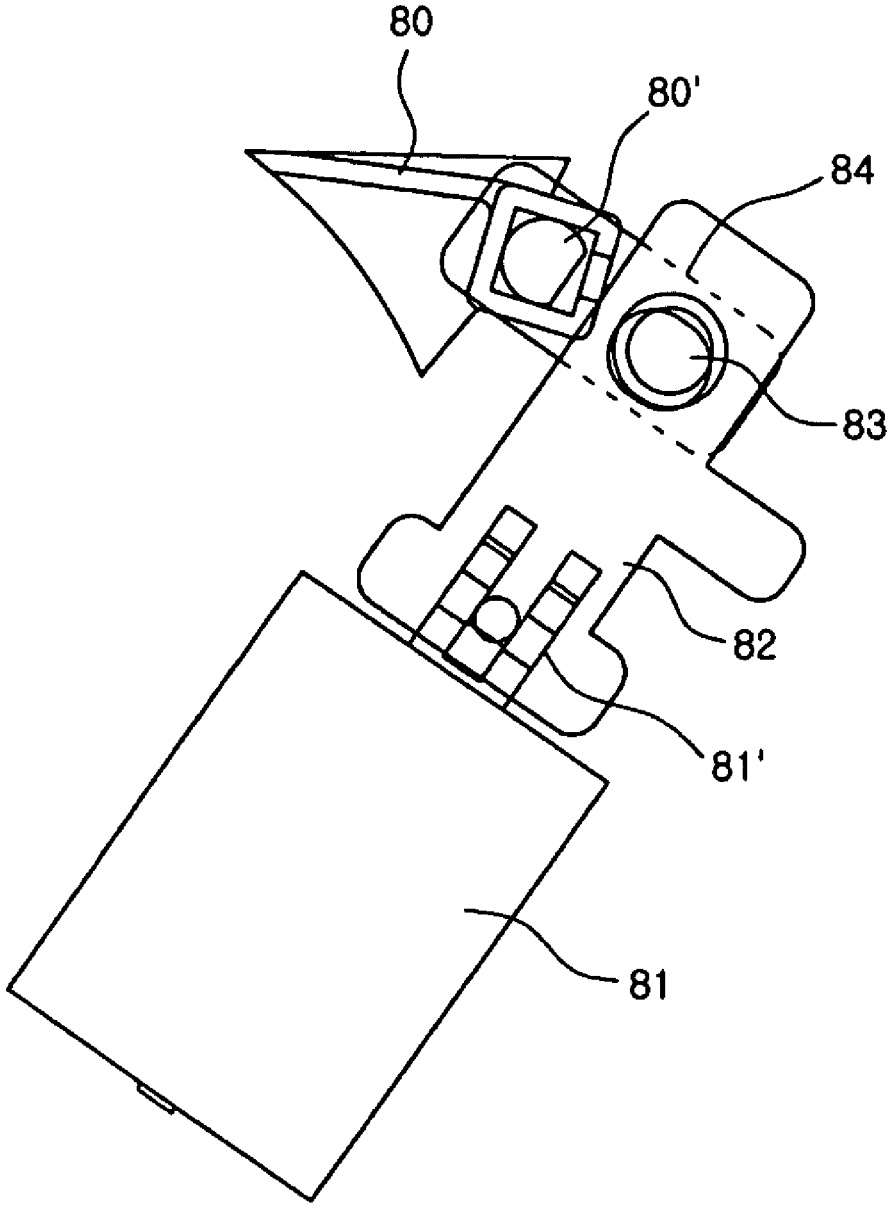
FIG. 6 is a side view showing the construction for driving a diverter in the embodiment of the present invention.

The construction relationship between the diverter 80 and the solenoid 81 is well shown in FIG. 6. A plunger 81' of the solenoid 81 is connected to a driving link 82, and the driving link 82 is connected to a connecting link 84 through a connecting shaft 83.

The connecting link 84 is connected to a diverter shaft 80' and rotates the diverter shaft 80'. The diverter shaft 80' is integrally formed with the diverter 80. Both ends of the diverter shaft 80' are supported by the second guide plates 20 and 20'. The solenoid 81 drives the diverter 80 to change the feeding path of the media between the discharge path or the reject path.

The discharge path of the media, via the diverter 80, is constituted by a plurality of third media guides 85 and a plurality of the fourth media guides 87. A predetermined gap, through which the media pass, is formed between the third and the fourth media guides 85 and 87. At least two of the third media guides 85 and at least two of the fourth media guides 87 are arranged in parallel with similar shapes, respectively.

The third media guides 85 are fixedly installed between the second guide plates 20 and 20', and the fourth media guides 87 are provided so that the roller 78 side portion is rotatable about a rotational shaft 104' by a predetermined angle. The configuration is similar to that of the assembly including the first media guides 68. Thus, a jam occurring between the third media guides 85 and the fourth media guides 87 can be removed. The assembly including the third media guides 85 and the assembly including the fourth media guides 87 may be formed so as to rotate by a predetermined angle.

In order to maintain the fourth media guides 87 at a predetermined spacing from the third media guides 85, a construction similar to the locker 70 of the first media guides 68 is provided. An explanation of the construction is omitted since it is similar to the locker 70.

Figure 7:
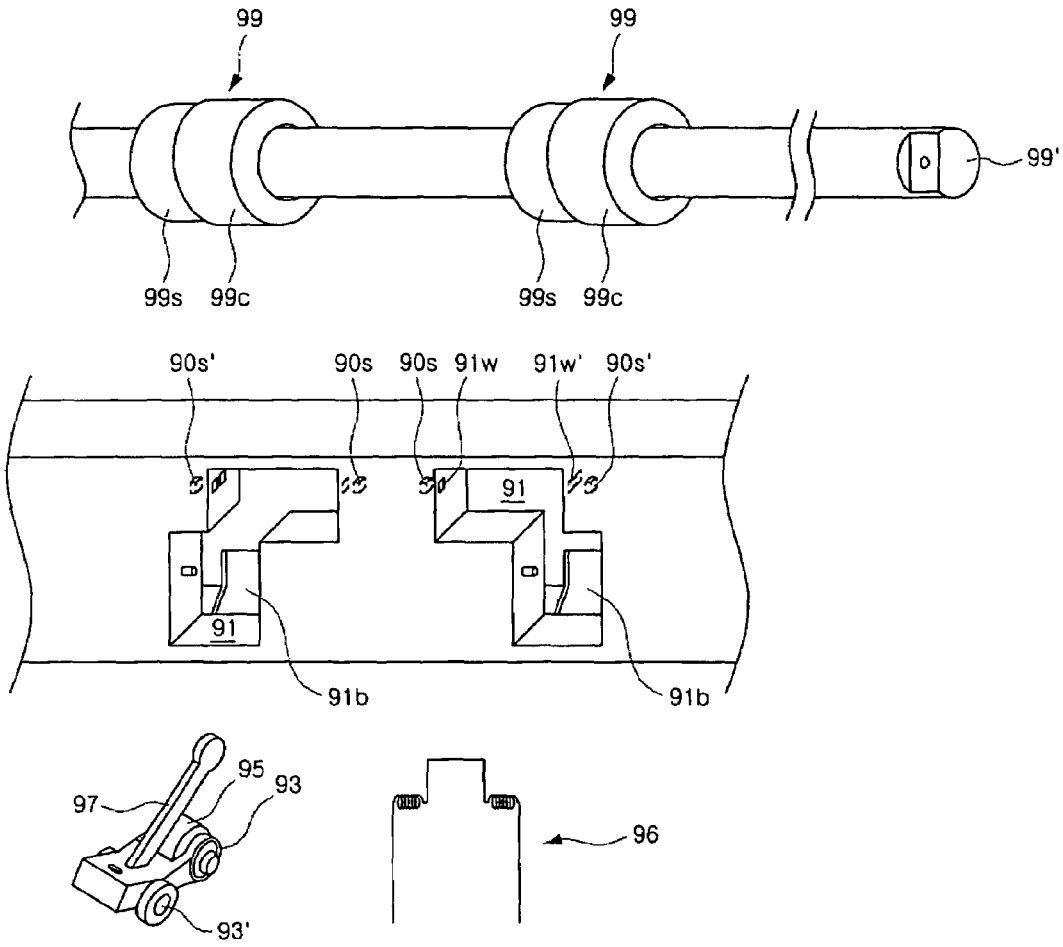
FIG. 7 is a partially cutaway exploded perspective view showing the construction of a media thickness sensing mechanism in the embodiment of the present invention.
Figure 8A:
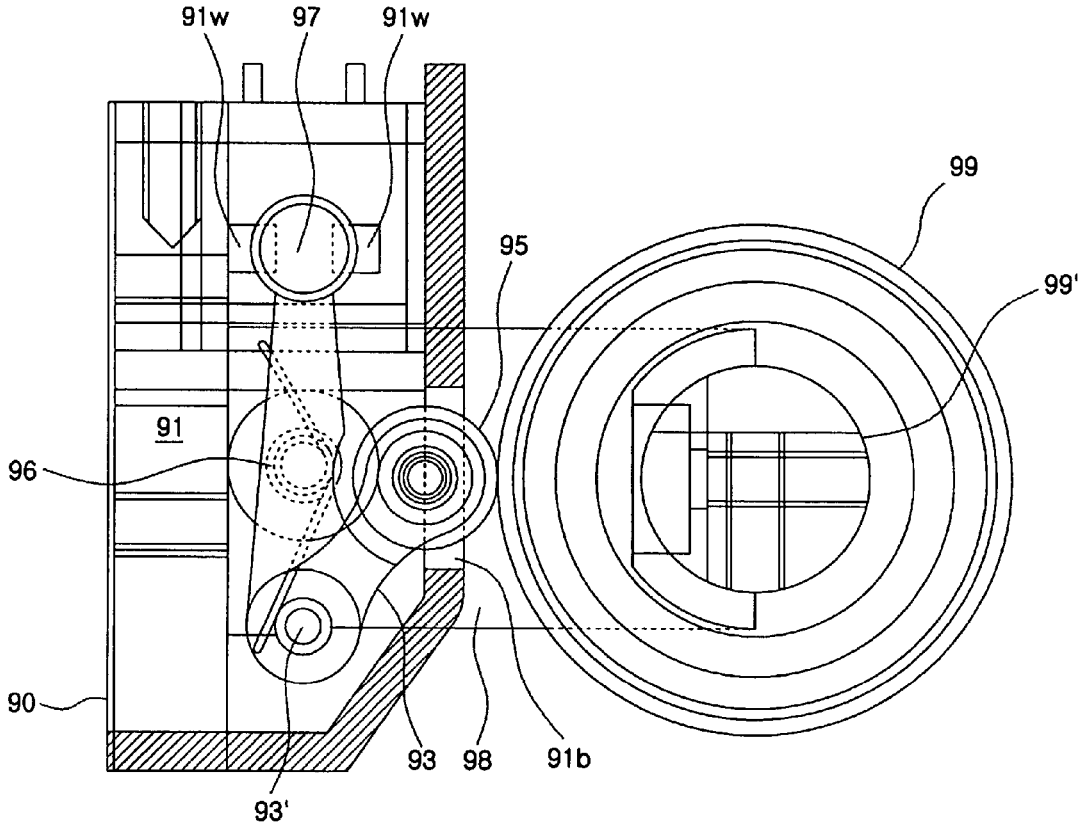
FIG. 8*a* is a side view showing portions of the media thickness sensing mechanism shown in FIG. 7.
Figure 8B:
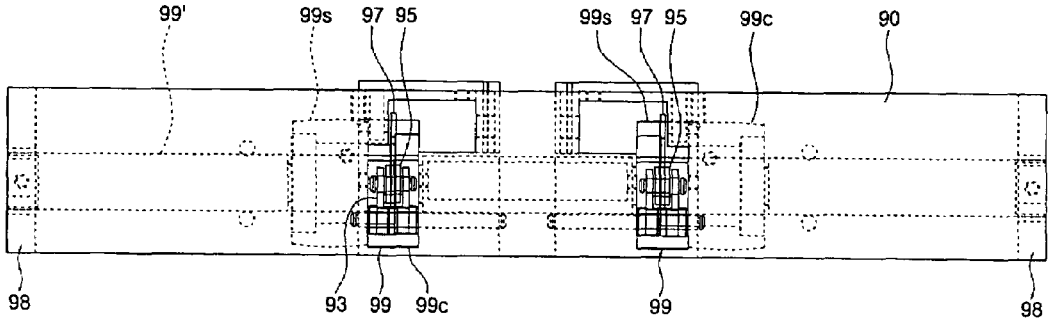
FIG. 8*b* is a view showing portions of the media thickness sensing mechanism shown in FIG. 7.

Referring to FIGS. 7 and 8, a construction for sensing the thickness of the media passing between the first media guides 68 and the second media guides 69 and preventing two or more stacked media from being discharged at a time, will be explained. In the present invention, the structure for sensing the thickness of the media is provided on a part of the path of the media formed between the first media guides 68 and the second media guides 69.

The first media guides 68 are provided with a sensing frame 90. The sensing frame 90 elongately extends from side to side between the second guide plates 20 and 20'. The sensing frame 90 is provided with two chambers 91. One side of each of the chambers 91 is provided with a bearing window 91*b* facing the second media guides 69.

A bearing holder 93 is installed in each of the chambers 91 so as to rotate about a rotational center 93'. The bearing holder 93 is provided with a sensing bearing 95. The sensing bearing 95 is freely rotatably installed at the front end of the bearing holder 93, and somewhat projects through the bearing window 91*b*. Each bearing holder 93 is biased to rotate in one direction about the rotational center 93' by a torsional spring 96 in each of the chambers 91. The sensing bearing 95 tends to project out of the bearing window 91*b* by the force of the torsional spring 96.

One side of the bearing holder 93 is elongately extended so that the front end thereof is provided with a shielding plate 97. The shielding plate 97 moves according to the rotation of the bearing holder 93, so that the thickness of the media is sensed by means of an optical sensor (a light emitting portion 90*s* and a light receiving portion 90*s'*). Light emitting windows 91*w* and light receiving windows 91*w'* are provided in opposite sides of each of the chambers 91, respectively. Two of the light receiving windows 91*w'* are formed as a pair, and the area of the light receiving windows 91*w'* screened by the shielding plate 97 varies according to the rotation of the bearing holder 93, so that the thickness of the media can be sensed by measuring an intensity of the light passing through the light receiving windows 91*w'*.

The chambers 91 are formed at two positions with a predetermined spacing in the sensing frame 90 and are provided with the bearing holders 93, respectively, each of which is provided with the sensing bearing 95. Thus, the thickness of the media may be sensed by using the two sensing bearings 95.

Connecting arms 98 are provided at both sides of the sensing frame 90, respectively. The connecting arms 98 extend to the front direction where the bearing windows 91*b* are open. The connecting arms 98 extend from both sides of the sensing frame 90, respectively, wherein a sensing roller shaft 99' is fixed to the connecting arms 98. The sensing roller shaft 99' are provided with rollers 99. Each of the rollers 99 comprises a portion 99*c* in contact with the conveyer belt 60 and a portion 99*s* in contact with the sensing bearing 95.

Referring to FIGS. 3 and 4 again, a gear train 100, which has a plurality of gears installed on the rotational shafts 45 to 102', is provided outside the second guide plate 20'. A rotating force of the rotational shaft 45 is transferred through the gear train 100 to the rotational shaft 102'. The rotational shaft 102' is provided with a plurality of rollers 102 between the second guide plates 20 and 20'. Both ends of the rotational shaft 102' are rotatably installed to the second guide plates 20 and 20'.

Rollers 104, corresponding to the rollers 102, are rotatably installed on the rotational shaft 104'. Both ends of the rotational shaft 104' are rotatably supported by the second guide plates 20 and 20'. The rotational shaft 104' is also a rotational center of the fourth media guides 87. The rollers 102 rotate by means of the rotational shaft 102', and the rollers 104 feed the media while rotating together with the rollers 102. Rollers for feeding the media may be further installed on the feeding path past the rollers 102 and 104 according to design conditions.

The structure for guiding the rejected media by changing the feeding direction by means of the diverter 80 will now be explained. The reject belts 106 are wound around the two rollers 77, which are installed on the rotational shaft 45 between the second guide plates 20 and 20'. The reject belts 106 are for feeding the rejected media. The reject belts 106 are also wound around rollers 108 installed on a roller shaft 108'.

In addition, the reject belts 106 contact with rollers 109 and 110, wherein the rollers 109 and 110 are installed on roller shafts 109' and 110', both ends of which are supported by the third media guides 85 or the second guide plates 20 and 20'. A part of each of the reject belts 106 is supported by a guide shaft 112.

The media guided by the reject belts 106 is fed through a predetermined gap formed between the third media guides 85 and fifth media guides 114. At least two of the fifth media guides 114 are installed with a predetermined spacing centering on the rotational shaft 45. An assembly including the fifth media guides 114 is formed so that a portion having the rollers 108 rotates about the rotational shaft 45, as the assembly including the first media guides 68. Both ends of the roller shaft 108' are supported in the fifth media guides 114, and both ends of the guide shaft 112 are also supported in the fifth media guides 114. Therefore, the fifth media guides 114 as an assembly may rotate about the rotational shaft 45 in a predetermined angle, so that jammed media can be removed.

A driving motor 115 is installed on the inner surface of the first guide plate 10. A driving gear 116 is installed on a rotational shaft of the driving motor 115, and a driven gear 117 is installed so as to be engaged with the driving gear 116. The driven gear 117 is coaxially installed on a rotational shaft 118, both ends of which are rotatably supported in the first guide plates 10 and 10'. The driving gear 116 and driven gear 117 are installed on the outer surface of the first guide plate 10. Reference numerals 119 and 119' designate a sensor and an encoder, respectively, wherein the sensor 119 and the encoder 119', which will be explained below, are installed on the outer surface of the first guide plate 10' in order to sense the rotation of stacking wheels 120.

As shown in FIGS. 3*d,* 9 and 10, the stacking wheels 120 are installed on the rotational shaft 118 between the first guide plates 10 and 10'. The stacking wheels 120 rotate by means of the rotational shaft 118, and feed the media, so that the stacking wheels 120 function to rest the media onto stacking plates 126, which will be explained below. The stacking wheels 120 are provided with a plurality of tangential wings 121 so as to extend in a tangential direction along the outer circumferential surface. The media are inserted between the tangential wings 121 one by one, and then fed to the stacking plates 126, which will be explained below, according to the rotation of the stacking wheels 120.

As seen in FIG. 3*d,* in the present embodiment, two pairs of the stacking wheels 120 are installed on the rotational shaft 118 with a predetermined spacing. An interval between the two pairs of the stacking wheels 120 can be varied according to the length of the media to be dispensed.

A solenoid 123 is installed on the outer surface of the first guide plate 10. A plunger of the solenoid 123 is connected to a connecting link 124, and the connecting link 124 is connected to a driving link 124'. The driving link 124' is connected to an end of a stacker shaft 125' so that the stacker shaft 125', both ends of which are rotatably supported in the first guide plates 10 and 10', rotates by a predetermined angle in response to actuation of the solenoid 123.

Stackers 125 are installed in the stacker shaft 125'. The stacking plates 126 are provided in a side of each of the stackers 125, wherein the stacking plates 126 are horizontally positioned at an initial state. The stacking plates 126 are positioned on the moving path of the media, inserted between the tangential wings 121 of the stacking wheels 120. However, the stacking wheels 120 and the stacking plates 126 are installed so that they alternate with each other in order not to interfere with each other, as shown in FIG. 3*d.* Therefore, the media, which rotate by the rotation of the stacking wheels 120, are smoothly erected and rested onto the stacking plates 126. The stackers 125 are pivoted by means of the solenoid 123 so as to be selectively at a position where the media can be stacked on the stacking plates 126 or a position where the media can be rejected.

Figure 11:
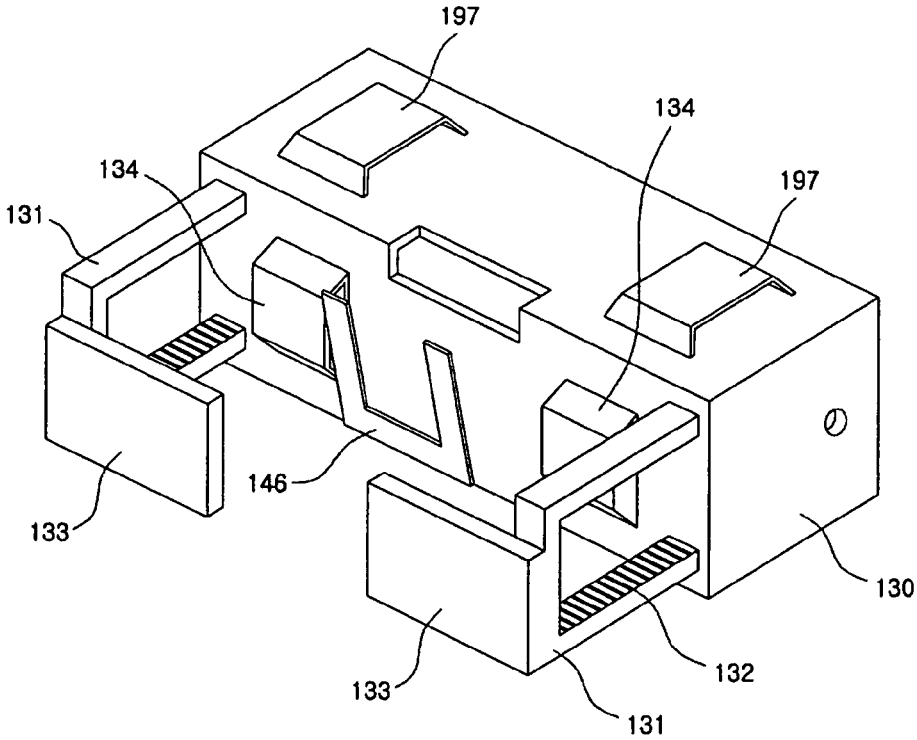
FIG. 11 is a perspective view showing the construction of a clamp housing of the stacking module in the embodiment of the present invention.

A construction for clamping the media erected and rested on the stacking plates 126 and transferring them to a holder assembly 150 will now be explained. A clamp housing 130 is installed between the first guide plates 10 and 10', as shown in FIG. 11. The clamp housing 130 is formed in a hexahedral shape so that the area of the surface facing the stacking wheels 120 corresponds to the area of the media. The clamp housing 130 is connected to a housing driving shaft 145, which will be explained below, and is installed to be rotatable by 90 degrees between the first guide plates 10 and 10'. In the present embodiment, the rear surface of the clamp housing 130 is open.

Clamp arms 131 are provided at both ends of the front surface of the clamp housing 130, respectively. The clamp arms 131, which may project out of or be received into the clamp housing 130, are formed in a "Π" shape. Each of the clamp arms 131 is provided with rack portions 132 to receive a driving force to move the clamp arms. The rack portions 132 are formed on upper and lower portions of each of the clamp arms 131, so as to face each other.

A clamping plate 133 having a predetermined area is formed in the front end of each of the clamp arms 131. The clamping plate 133 is formed integrally with the front end of the clamp arm 131 in parallel with the front surface of the clamp housing 130.

Figure 9:
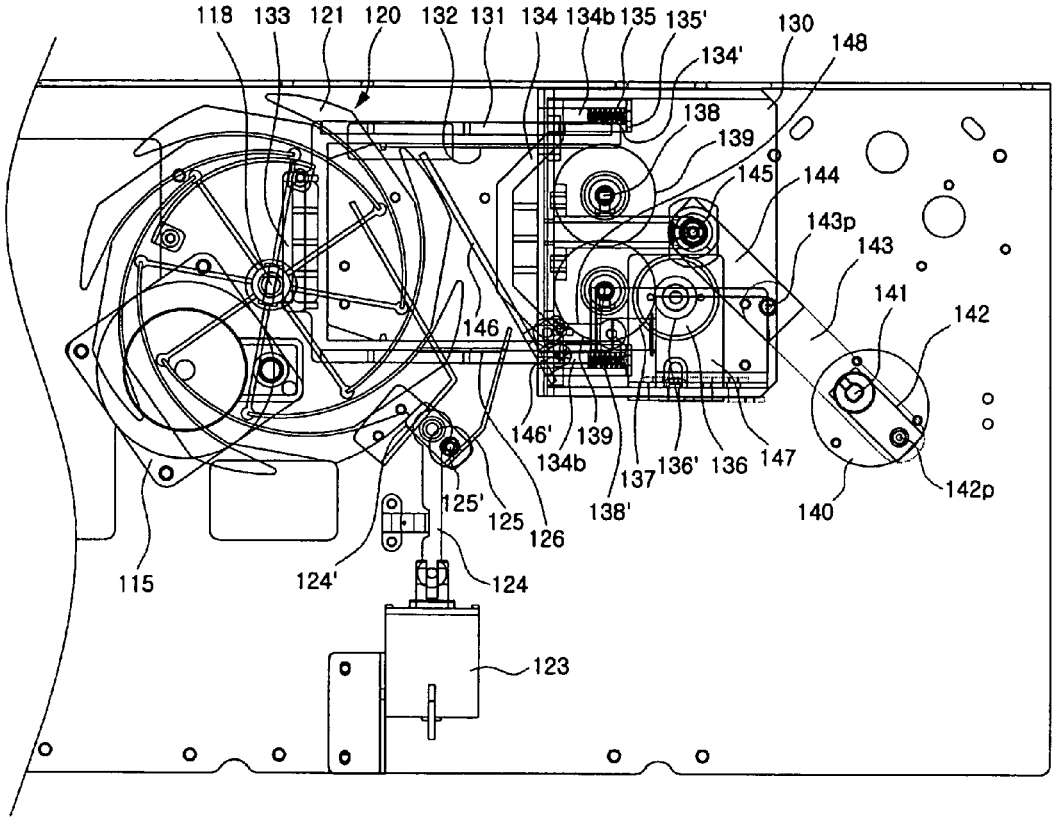
FIG. 9 is a partially sectional view showing the construction of a stacking module in the embodiment of the present invention.
Figure 10:
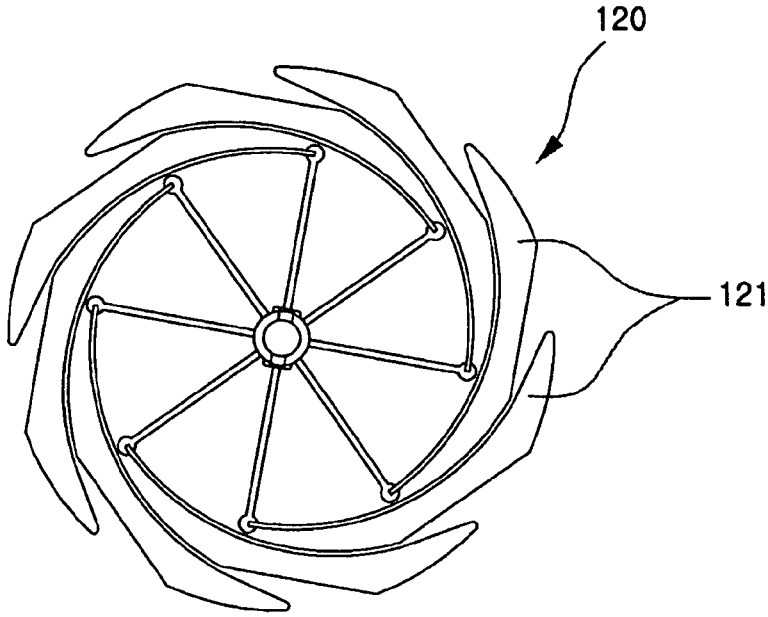
FIG. 10 is a side view showing the construction of a stacking wheel of the stacking module in the embodiment of the present invention.

The front surface of the clamp housing 130, corresponding to the clamping plates 133 is provided with elastic plates 134. Each of the elastic plates 134 has an area approximately corresponding to that of the clamping plate 133, and is installed so as to project out of or be received into each opening formed in the front surface of the clamp housing 130. Each of the elastic plates 134 is supported by elastic members 135 in the clamp housing 130, as shown in FIG. 9. The elastic members 135 support the elastic plates 134 at upper and lower ends, inside the clamp housing 130, and then generate an elastic force for projecting the elastic plates 134 out of the front surface of the clamp housing 130.

In order to guide the elastic plates 134, guide ribs 134' are formed on the upper and the lower ends of the opening formed in the front surface of the clamp housing 130, inside the clamp housing 130, respectively. The guide ribs 134' extend in the front and rear direction, i.e., in the moving direction of the elastic plates 134, inside the clamp housing 130. Guide bosses 134*b* are formed at the upper and the lower ends of the elastic plates 134 and are movably inserted into the guide ribs 134'.

The elastic members 135 are installed inside the guide ribs 134' so that an end of the elastic members 135 supports an end of the guide bosses 134*b,* and shielding plates 135' are provided at an end of the guide ribs 134' so as to support the other end of the elastic members 135. The elastic plates 134 are assembled by assembling the guide bosses 134*b* on the upper and the lower ends of the guide ribs 134' through an end portion thereof with the shielding plates 135' removed, inserting the elastic members 135 into the guide ribs 134', and mounting the shielding plates 135'. It is preferable for stable motion of the elastic plates 134 that a plurality of the guide ribs 134' and the guide bosses 134*b* are formed at positions corresponding to the upper and the lower ends of the elastic plates 134.

An arm driving motor 136 is provided in the clamp housing 130. A driving gear 136' is provided on a rotational shaft of the arm driving motor 136, and a driven gear 137 is installed so as to be engaged with the driving gear 136'. The driven gear 137 is installed coaxially with a gear shaft 138', which will be explained below.

Gear shafts 138 and 138' are provided in the clamp housing 130 and extend along both sides thereof. Pinion gears 139 are installed on both ends of the gear shafts 138 and 138' so as to be engaged with the rack portions 132 formed on the clamp arms 131, respectively, and transfer a driving force thereto. The pinion gears 139 formed on the corresponding ends of the gear shafts 138 and 138' are engaged with each other and are also engaged with the rack portions 132. Therefore, a driving force of the arm driving motor 136 is transferred to the pinion gears 139 through the gear shaft 138', which is rotated by the driven gear 137, which causes the clamp arms 131 to move.

Now, the construction for rotating the clamp housing 130 by 90 degrees will be explained. A housing motor 140 is installed inside the first guide plate 10, as shown in FIG. 3*d.* A motor shaft 141 of the housing motor 140 is integrally connected to an end of a driving link 142. The driving link 142 is provided outside the first guide plate 10. The driving link 142 rotates integrally with the motor shaft 141. The other end of the driving link 142 is connected to an end of a first connecting link 143. The driving link 142 and the first connecting link 143 are freely pivotably connected to each other by means of a pin 142*p.*

The other end of the first connecting link 143 is connected to an end of a second connecting link 144. The second connecting link 144 and the first connecting link 143 are also freely pivotably connected to each other by means of a pin 143*p*. However, the other end of the second connecting link 144 is integrally rotatably connected through the clamp housing 130 to a housing driving shaft 145, both ends of which are supported in the first guide plates 10 and 10'. Due to the construction, the clamp housing 130 is selectively positioned between a direction where the clamp arms 131 extend toward the stacking wheels 120 and a direction where the clamp arms 131 extend toward the tray frame 30.

A damper plate 146 is provided in the front surface of the clamp housing 130 between the elastic plates 134. The damper plate 146, which is formed in a "Π" shape, is installed with an inclination so that both ends thereof are adjacent to the stacking wheels 120. The damper plate 146 is also installed in the front end of the clamp housing 130 so as to rotate about a rotational center 146' by a predetermined angle.

The damper plate 146 is driven by a damper solenoid 147 installed in the clamp housing 130. The damper solenoid 147 and the damper plate 146 are connected to each other by a connecting link 148, as shown in FIG. 9, and the front end of the damper plate 146 rotates about the rotational center 146' by driving the damper solenoid 147.

In addition, the damper plate 146 is at a position where it is closely adjacent to the front surface of the clamp housing 130 or a position where as shown in FIG. 9 it is tangential to the stacking wheels 120.

Referring to FIGS. 12 to 16, the construction of the stack delivery module 5 will be explained. The tray frame 30 is mounted on the upper end flanges 12 and 12' formed on the upper ends of the first guide plates 10 and 10' through mounting flanges 32 in both lower sides of the tray frame 30. Both side surfaces of the tray frame 30 are formed with interference avoidance slots 33.

In addition, engaging holes 35 and engaging elongate holes 36 for engaging with the upper end flanges 12 and 12' of the first guide plates 10 and 10' are formed in the mounting flanges 32 provided in both sides of the tray frame 30. The engaging hole 35 is formed in a circular shape, and the engaging elongate hole 36 is formed in an elliptic shape. The engaging hole 35 is formed at the longitudinal center of each of the mounting flanges 32, and a plurality of the engaging elongate holes 36 are formed at both sides of the engaging hole 35, which is the reason why the tray frame 30 can be precisely mounted.

A holder assembly 150 is movably provided in the tray frame 30. The holder assembly 150 functions to feed a plurality of the stacked media fed from the clamp housing 130 of the stacking module 3 all at a time.

Figure 13:
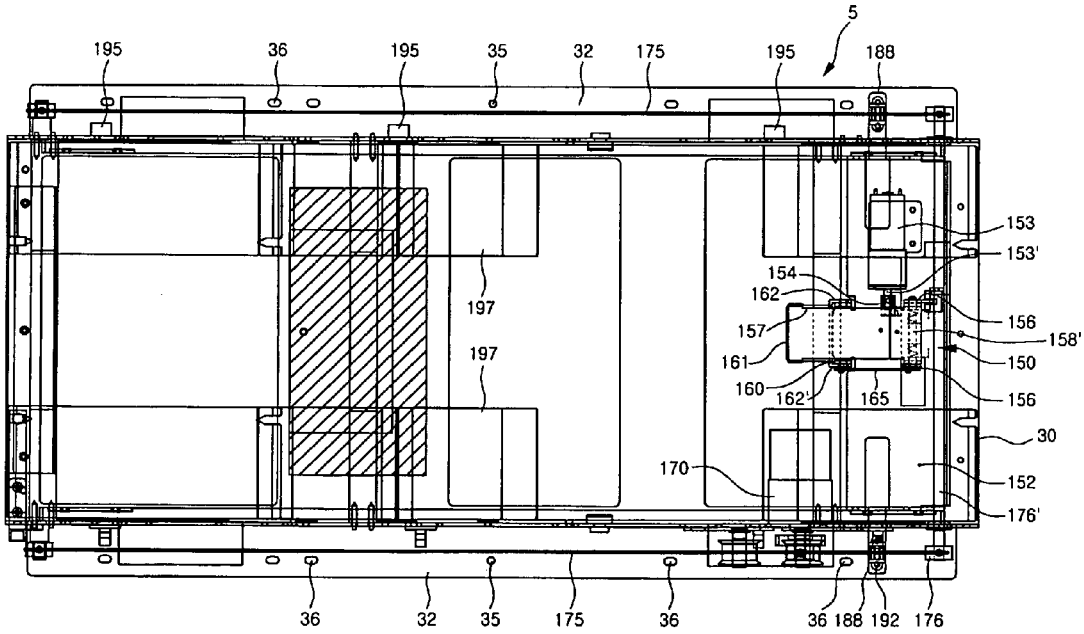
FIG. 13 is a plane view showing the construction of the stacking delivery module in the embodiment of the present invention.
Figure 14:
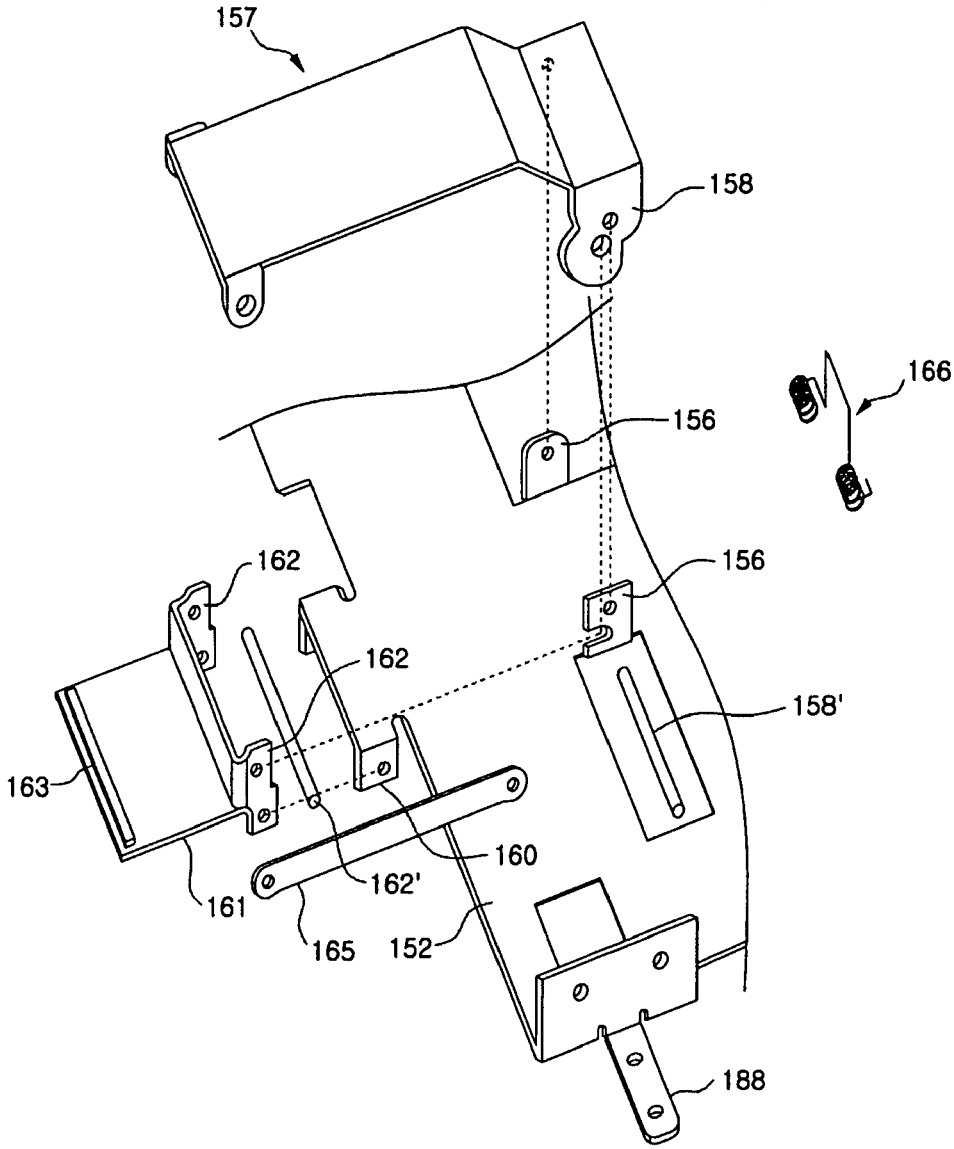
FIG. 14 is an exploded perspective view showing portions of a holder assembly in the embodiment of the present invention.

The holder assembly 150 is provided with a holder tray 152. The holder tray 152 is formed elongately in a width direction of the tray frame 30, when it is seen in FIG. 13. A holder motor 153 is provided on the holder tray 152. A motor shaft 153' of the holder motor 153 is provided with a bushing cam 154, on a portion of which a cam portion 155 is formed to project in a radial direction.

A pair of upper brackets 156 are vertically formed on an upper surface of a portion of the holder tray 152 with a predetermined spacing between them. An upper holder 157 is installed in the upper brackets 156. Connecting pieces 158 are vertically bent and formed at the rear end of the upper holder 157 in a position corresponding to the upper brackets 156. The connecting pieces 158 are pivotably connected to the upper brackets 156 through a hinge pin 158', respectively.

A frictional member 159, which is formed in a circular cylindrical shape, is provided at the front end of the upper holder 157, and is installed on a frictional member shaft 159', both ends of which are supported at both sides of the upper holder 157. The upper holder 157 clamps a center portion of a stack of media. The upper holder 157 is formed so that its width is smaller than its length and the width of the media.

The holder tray 152 is formed with a pair of lower brackets 160 opposite to the upper brackets 156. A lower holder 161 is installed between the lower brackets 160. Connecting pieces 162, which are vertically bent and formed at the rear end of the lower holder 161, are connected to the lower brackets 160 through a hinge pin 162', respectively. A frictional member 163 is provided at the front end of the lower holder 161. The frictional member 163 contacts one surface of a stack of media while the frictional member 159 of the upper holder 157 contacts the opposing surface of the stack of media.

In addition, an end of a connecting link 165 is connected to a portion of one of the connecting pieces 162 of the lower holder 161 through a pin 165*p*, wherein the portion is opposite to the hinge pin 162', by which the lower brackets 160 are connected to the connecting pieces 162. The other end of the connecting link 165 is connected to one of the connecting pieces 158 of the upper holder 157 by a pin 165*p*. The connecting link 165 is connected to the connecting piece 162 of the lower holder 161 and to the connecting piece 158 of the upper holder 157, so that the front end of the upper holder 157 and the front end of the lower holder 161 simultaneously move toward each other or away from each other.

The rear end of the upper holder 157 is supported by an elastic member 166 installed on the hinge pin 158', so that the upper holder 157 is subjected to an elastic force tending to move the front end of the upper holder 157 into contact with the front end of the lower holder 161.

Therefore, in order to separate the front end of the upper holder 157 from the front end of the lower holder 161, the elastic force of the elastic member 166 must be overcome by the cam portion 155 of the bushing cam 154. An end of the elastic member 166 is supported at the rear end of the upper holder 157, and the other end thereof is supported at the holder tray 152.

A sensor 168, which senses the operational condition of the upper and lower holders 157 and 161 by sensing a detective piece 158*t* projecting from the upper holder 157, is installed in a sensor bracket 167 in the holder tray 152.

Next, the construction for moving the holder assembly 150 will be explained. A tray motor 170 is installed on the inner surface of the first guide plate 10, as shown in FIG. 13. A driving gear 172 is installed on a rotational shaft of the tray motor 170. The driving gear 172 is installed on the outer surface of the first guide plate 10. A driven gear 173 is installed so as to be engaged with the driving gear 172. The driven gear 173 is installed coaxially with a pulley shaft 174', on which a driving pulley 174 is installed.

A timing belt 175 is wound around the driving pulley 174. The timing belt 175 is also wound around end pulleys 176, which are provided at both ends of a side surface of the tray frame 30, respectively. Another timing belt 175 is further provided on the other side surface of the tray frame 30, as shown in the figure. At this time, a driving force from the tray motor 170 can be transferred to the timing belt 175 opposite to the tray motor 170 through an end pulley shaft 176', on which the end pulleys 176 at both sides of an end of the tray frame 30 are installed.

Figure 12:
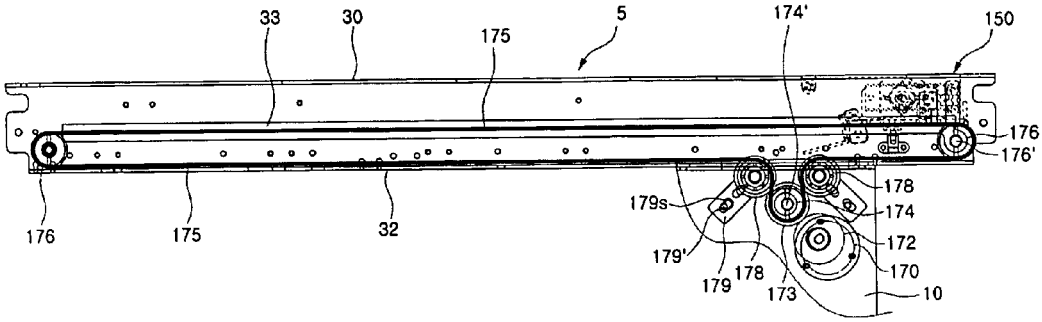
FIG. 12 is a side view showing the construction of a stacking delivery module in the embodiment of the present invention.

There are provided tension pulleys 178 for controlling a tension of the timing belt 175, as shown in FIG. 12. The tension pulleys 178 are installed at both sides of the driving pulley 174, and contact with both sides of the portion of the timing belt 175 wound around the driving pulley 174.

Each of the tension pulleys 178 is installed on a separate pulley bracket 179, which is mounted in the first guide plate 10. The pulley bracket 179 is formed with a control elongate hole 179'. Therefore, the tension of the timing belt 175 may be controlled by controlling a position of the pulley brackets 179 on the first guide plate 10 and inserting an engaging screw 179 through the control elongate hole 179' to mount the pulley brackets 179 on the first guide plate 10.

Side rails 180 are provided on both inner sides of the tray frame 30. Each of the side rails 180 is installed movably along a guide channel 34, which is elongately formed along and above the interference avoidance slot 33. Bearing balls 181 are installed on the upper and the lower ends of the side rails 180 so that portions of each of the balls 181 are exposed.

Guide brackets 185 are provided on both sides of the holder tray 152 at positions corresponding to the side rails 180. Guiders 187, which are movably rested on the side rails 180, are provided in the guide brackets 185.

Belt brackets 188 are formed in the holder tray 152 so as to project through the interference avoidance slots 33 in the side direction of the tray frame 30. Portions of the belt brackets 188 project out of the tray frame 30 and are engaged with belt holders 190, respectively. The timing belt 175 is positioned between the belt bracket 188 and the belt holder 190. The belt holder 190 and the belt bracket 188 are engaged by means of engaging screws 192.

A detective piece 193 is formed on, or attached to, the belt holders 190 so as to project downward. A position of the detective piece 193 is sensed by a plurality of sensors 195 provided along a side surface of the tray frame 30. Four sensors 195 are provided for sensing an initial position of the holder tray 152, a holding position of the media, a position where the holder tray 152 is adjacent to a discharge part, and a position where the holder tray 152 arrives at the discharge portion, i.e., a final position.

Reference numeral 197 designates media supporting guides, which function to prevent the media from sagging at both sides thereof when the upper holder 157 and the lower holder 161 move with the media held thereby. The media supporting guides 197 are provided at both sides of a moving path of the holder assembly 150, alternatively at both sides of the upper surface of the clamp housing 130.

The operation of the media discharging unit for a media dispenser according to the present invention having the above construction will now be explained in detail. The media are separated one-by-one from a media cassette mounted in the media dispenser, are fed along a predetermined path to the delivery module 1. The media are fed from the delivery module 1 by a driving force of the driving motor 40. The driving force of the driving motor 40 is transferred through the driving pulley 42, the driving belt 43, the driven pulley 47, the rotational shaft 45, the connecting pulley 48, the connecting belt 49, the driven pulley 50, the rotational shaft 51, the driving gear 52, the driven gear 56, the rotational shaft 55, and the rollers 58 to the conveyer belts 60. Therefore, the media are fed between the first and the second media guides 68 and 69 by the conveyer belts 60. In particular, the media are fed between the conveyer belts 60 and the rollers 53, 58, 63, 64 and 65.

When the media pass between the first media guides 68 and the second media guides 69, the thickness of the media is sensed between the sensing bearing 95 and the sensing roller 99. The sensing bearing 95, which closely contacts with the sensing roller 99 because of the torsional spring 96, is separated from the sensing roller 99 by the passage of the media. Therefore, the bearing holder 93 overcomes an elastic force of the torsional spring 96 and simultaneously rotates counterclockwise with respect to the rotational center 93'.

Therefore, the shielding plate 97 rotates integrally with the bearing holder 93, so that the area covering both the light emitting windows 91*w* varies. Thus, an intensity of light transferred from the light emitting portion 90*s* via the light emitting windows 91*w* to the light receiving portion 90*s'* varies. By sensing the intensity of the light received at the light receiving portion 90*s'*, the thickness of the media can be determined.

The thickness detector, as described above, is provided at two positions corresponding to both sides of the media. Therefore, when the thickness of a right side of the media is different from the thickness of a left side of the media, a misfeed is determined (unless the media actually has unequal thicknesses at the right versus left side) and the number of the media fed can be more precisely confirmed. Thus, the media dispenser of the present invention can be applied to media of various properties. In addition, two or more of the media which are fed at a time by the sensing bearing 95 and the sensing rollers 99 can be sensed as well.

Figure 19:
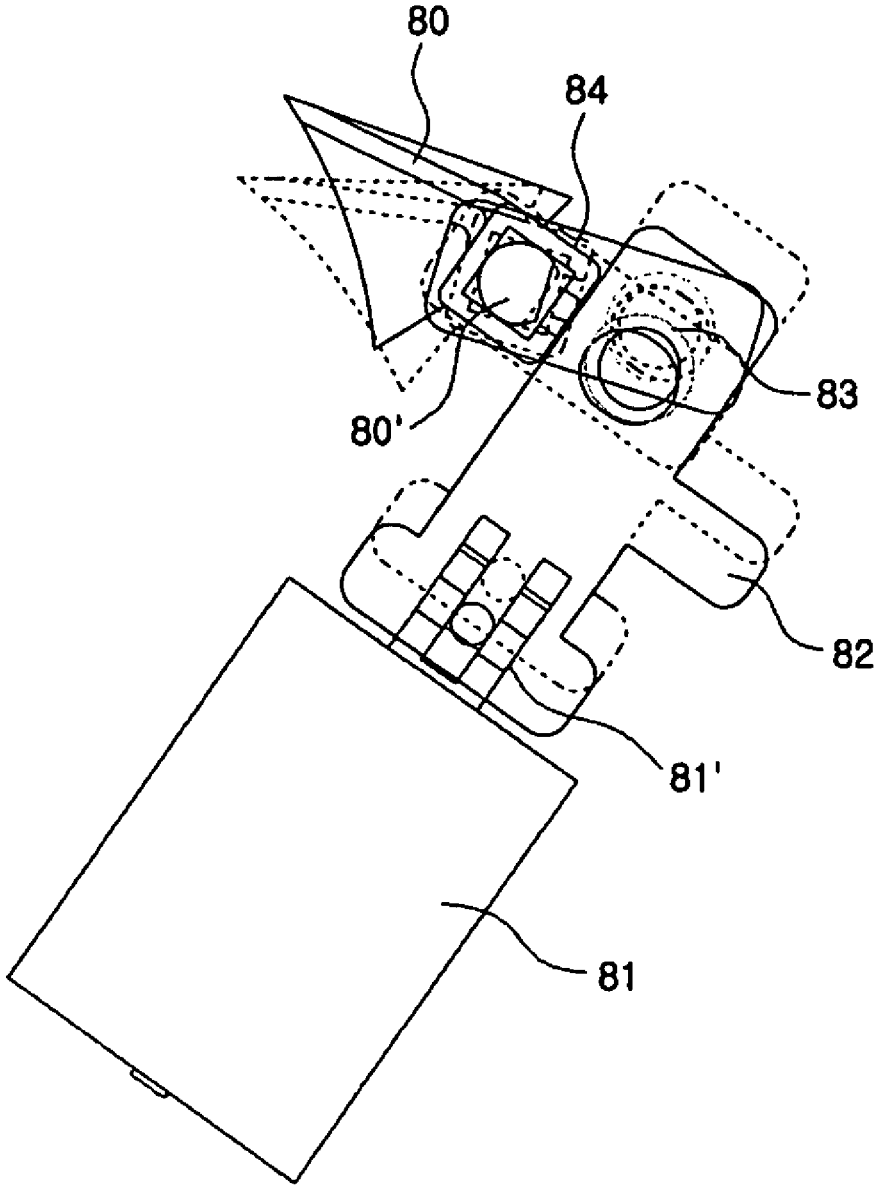
FIG. 19 is an operational state view illustrating how the diverter is operated in the embodiment of the present invention.

The media passing between the rollers 63 and 64, passes between the rollers 78 and the rollers 77, driven by the rotation of the rotational shaft 45. In addition, immediately after the media passes between the rollers 77 and the rollers 78, a feeding path is determined by the diverter 80. That is, if it is determined on the basis of the data detected from the sensing bearing 95 and the sensing rollers 99 that two stacked media are fed simultaneously, the front end of the diverter 80 is erected by operating the solenoid 81, as indicated by a dotted line in FIG. 19.

Figure 17:
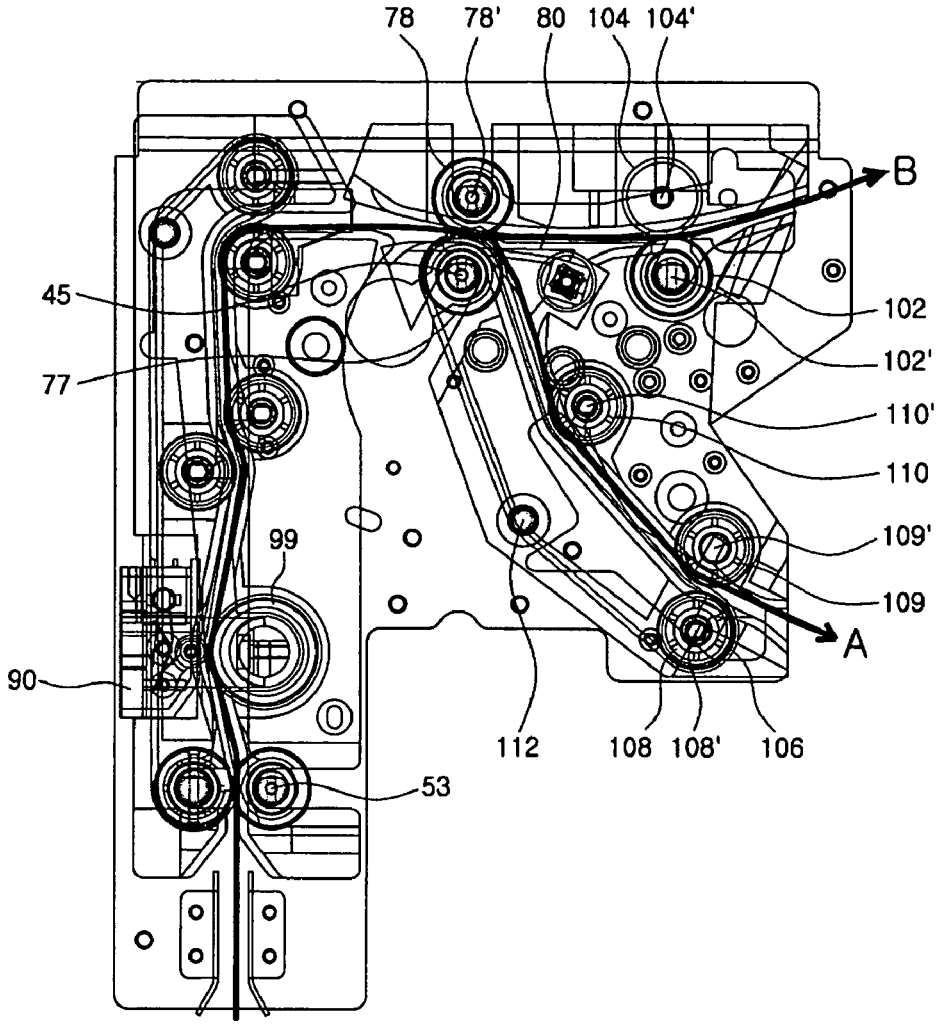
FIG. 17 is an operational state view showing the feeding path of media in the delivery module of the embodiment of the present invention.
Figure 18:
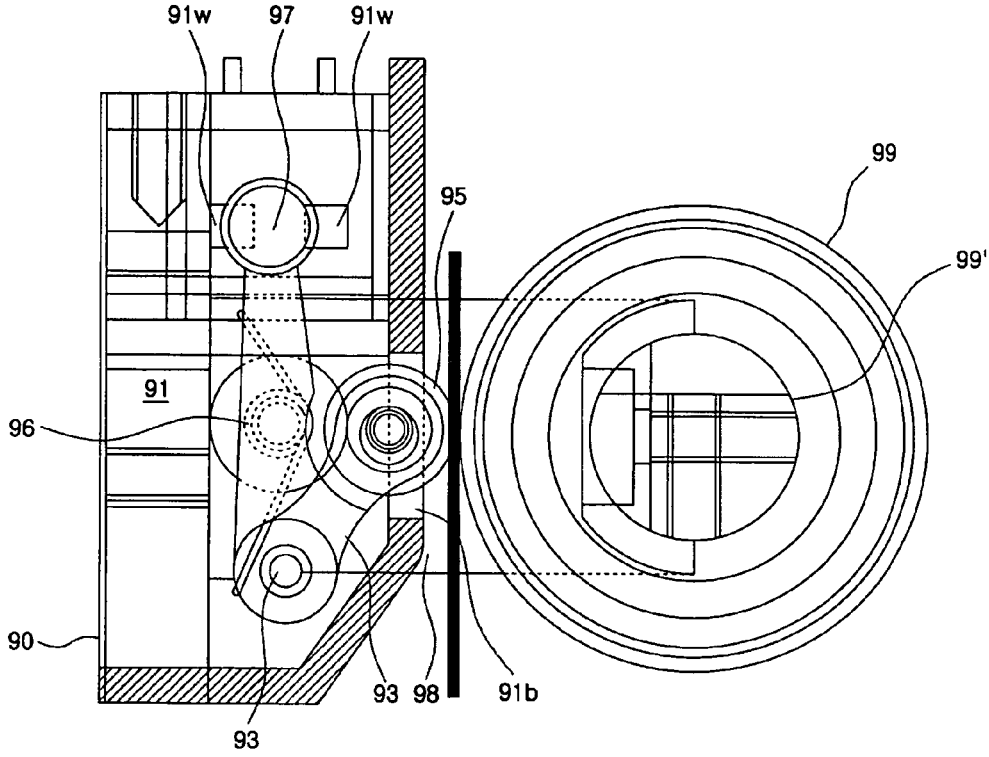
FIG. 18 is an operational state view illustrating how the thickness of the media is detected in the embodiment of the present invention.

Then, the media are guided along the lower portion of the front end of the diverter 80, and then are rejected through a path formed between the third media guides 85 and the fifth media guides 114. That is, the media are fed by the reject belts 80 and the rollers 109 and 110, and continue to be fed in the direction of an arrow A in FIG. 17.

When the media are normally fed one-by-one, the media are guided along the upper surface of the diverter 80 to pass between the rollers 104 and the rollers 102, and continue to be fed in the direction of arrow B.

When the media are fed to the delivery module 1, if a jam occurs between the first and the second media guides 68 and 69, the assembly including the first media guides 68 may be rotated about the rotational shaft 55 counterclockwise (in FIG. 4) after releasing the engagement between the lockers 70 and locker pins 75. By the above rotation, a gap between the first media guides 68 and the second media guides 69 becomes larger, so that it is easy to pull out the jammed media. If the assembly including the fourth media guides 87 is rotated about the rotational shaft 78', any media jammed between the third and the fourth media guides 85 and 87 can be easily removed. If the assembly including the fifth media guides 114 is rotated about the rotational shaft 45, any media jammed between the third and the fifth media guides 85 and 114 can be easily removed.

The media passing between the third and the fourth media guides 85 and 87 are inserted between the tangential wings 121 of the stacking wheels 120, and rotate together with the tangential wings 121. The stacking wheels 120 are driven by the driving motor 115. That is, a driving force from the driving motor 115 is transferred through the driving gear 116 and the driven gear 117 to the rotational shaft 118, so that the stacking wheels 120 installed on the rotational shaft 118 rotate.

The media, which are inserted between the tangential wings 121 of the stacking wheels 120, trip on the stacking plates 126 of the stackers 125, and are then erected. The stacking plates 126 are positioned so that they do not to interfere with the rotation of the stacking wheels 120.

Figure 20A:
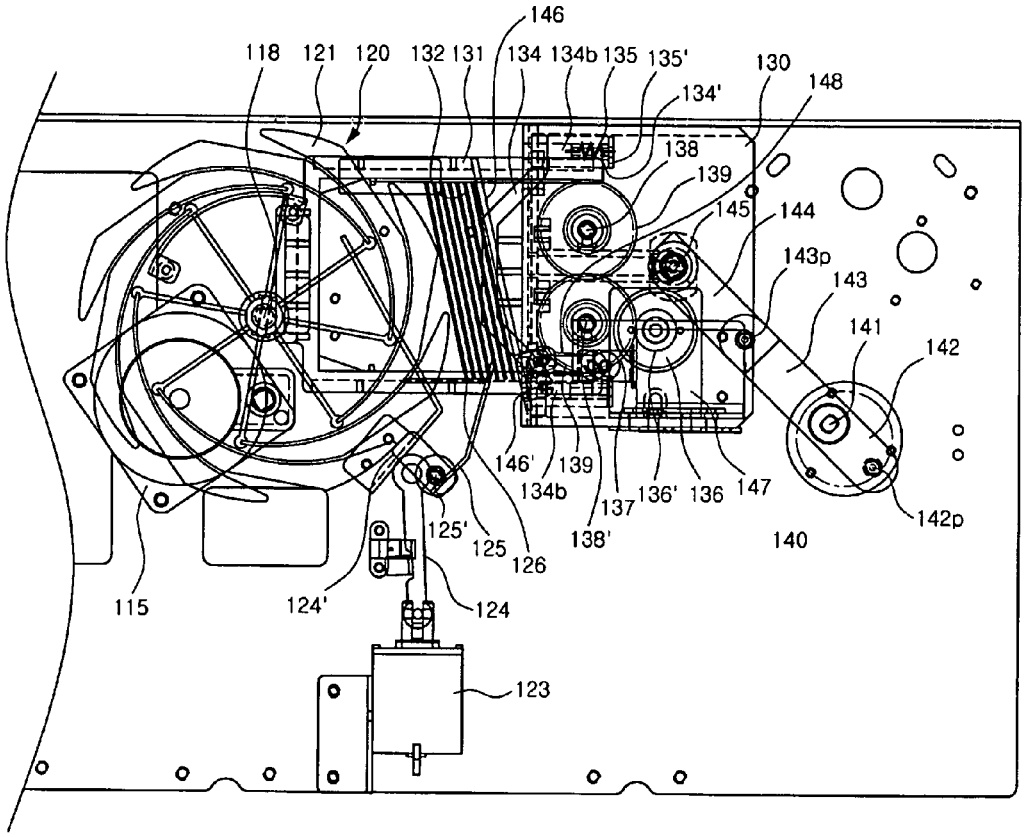
FIGS. 20*a* to 20*c* are operational state views sequentially illustrating how the stacking module of the embodiment of the present invention is operating.

The damper plate 146 causes a stack of the media to closely contact with each other. That is, as shown in FIG. 20*a*, the media on the stacking plates 126 are erected one by one with an inclination between the damper plate 146 and the stacking wheels 120. When the media are resting on the stacking plates 126, the clamp arms 131 maximumly project from the clamp housing 130, so that the clamping plates 133 project beyond the front end of the stacking plates 126.

Once the desired number of sheets of media are rested on the stacking plates 126, the driving motor 40 stops. Then, the clamping plates 133 force the media, rested on the stacking plates 126, into close contact with the elastic plates 134, which are provided on the front surface of the clamp housing 130. At this time, the damper plate 146 closely contacts with the front surface of the clamp housing 130 by driving the damper solenoid 147.

The clamping plates 133 are driven by the arm driving motor 136. When the arm driving motor 136 is driven, the driving force is transferred via the driving gear 136', the driven gear 137, and the gear shaft 138', to the pinion gears 139 of the gear shaft 138'. Since the pinion gears 139 are engaged with the rack portions 132 of the clamp arms 131, the clamp arms 131 move into the inside of the clamp housing 130.

While the clamp arms 131 move into the clamp housing 130, the clamping plates 133 force the media into close contact with the elastic plates 134. The elastic plates 134 are subjected to an elastic force in the direction in which they project to the front surface of the clamp housing 130. If the elastic plates 134 somewhat move in the direction of the front surface of the clamp housing 130, the media are securely fixed between the elastic plates 134 and the clamping plates 133.

Since the elastic plates 134 function to push the media toward the clamping plates 133, the media closely contact with each other and are securely fixed between the elastic plates 134 and the clamping plates 133. After clamping the media between the elastic plates 134 and the clamping plates 133 as above, the clamp housing 130 rotates.

At this time, the housing motor 140 rotates only counterclockwise. The housing motor 140 and the clamp housing 130 are connected to each other by means of a plurality of the links 142, 143 and 144, wherein the driving link 142 is fixed to the motor shaft 141, and the second connecting link 144 is also fixed to the housing driving shaft 145. Thus, the first connecting link 143 is pivoted about the driving link 142 and the second connecting link 144, respectively, so that the clamp housing 130 is forced to rotate. The clamp housing 130 begins to normally rotate as illustrated in of FIG. 20*b*, and to reversely rotate as illustrated in of FIG. 20*c*. When the clamp housing 130 clamping the media reaches the state illustrated in FIG. 20*c*, the media are positioned on a moving path of the holder assembly 150.

Figure 21:
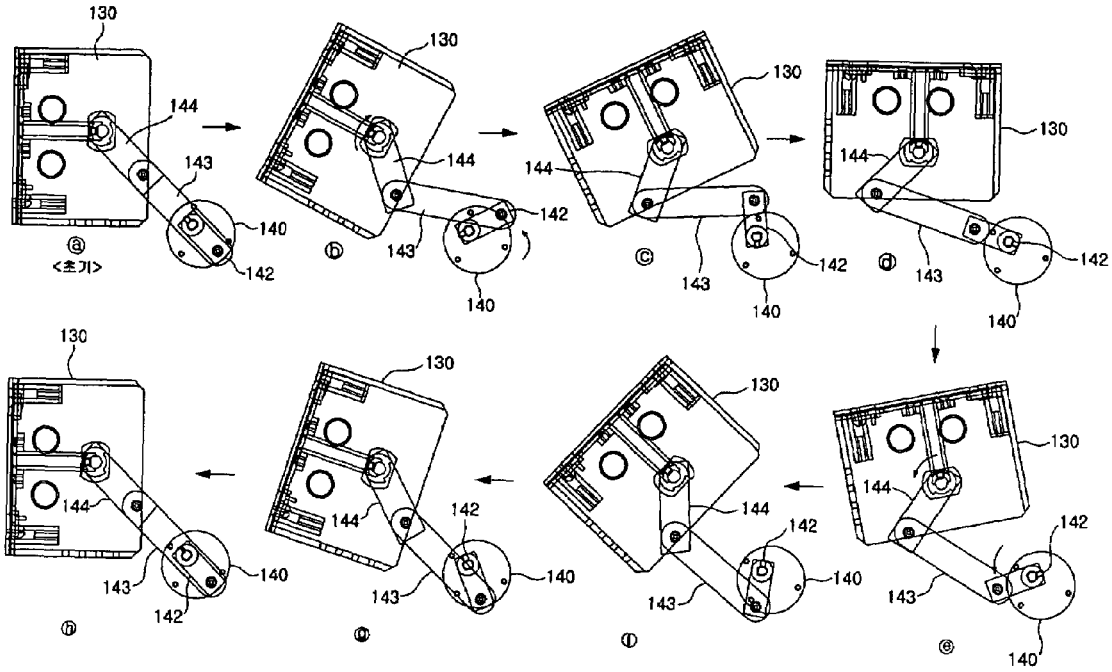
FIG. 21 is an operational state view sequentially illustrating how the clamp housing is driven by a housing motor in the embodiment of the present invention.

FIG. 21 sequentially shows that the clamp housing 130 rotates normally and reversely by means of the rotation of the housing motor 140 in a constant direction. As illustrated, in FIGS. 21*a* to 21*c*, while the housing motor 140 rotates counterclockwise, the clamp housing 130 rotates clockwise. In FIGS. 21*e* to 21*h*, while the housing motor 140 continues to rotate counterclockwise, the clamp housing 130 also rotates counterclockwise.

Figure 15:
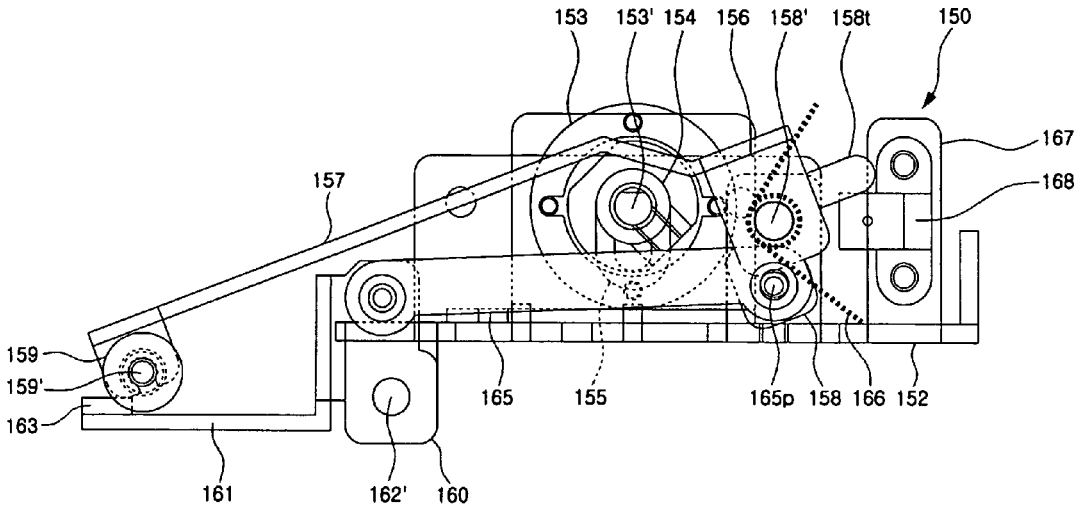
FIG. 15 is a side sectional view showing the construction of the holder assembly in the embodiment of the present invention.
Figure 16:
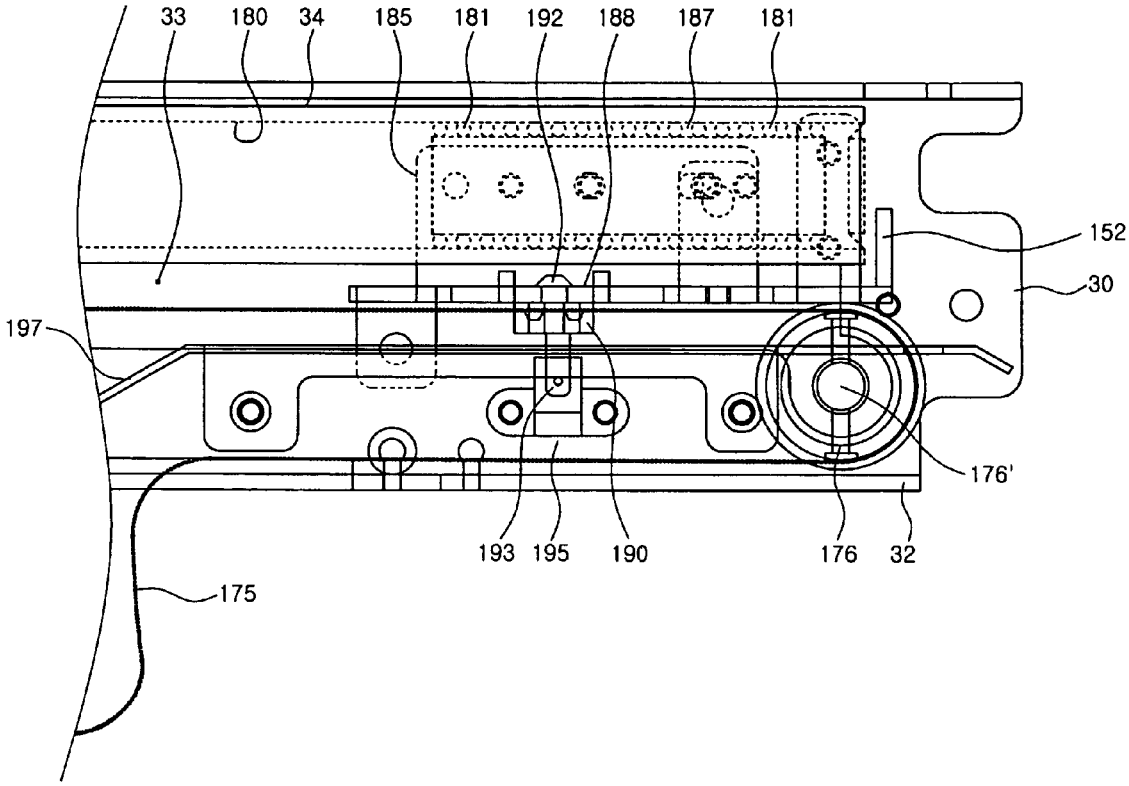
FIG. 16 is a side view showing the construction for feeding the holder assembly in the embodiment of the present invention.
Figure 22:
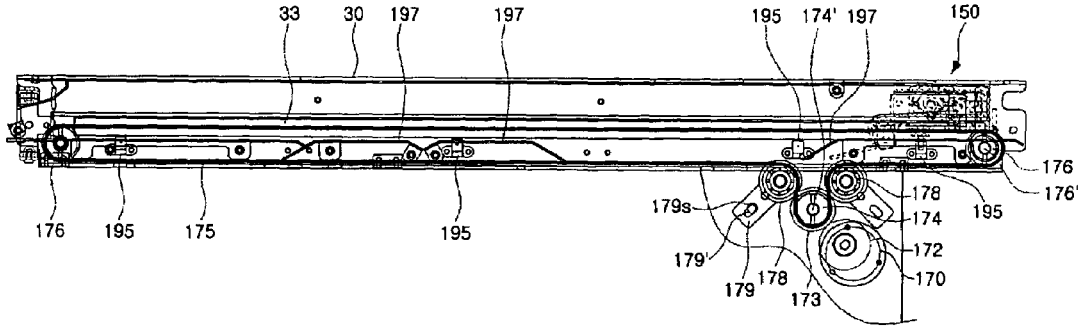
FIG. 22 is an operational state view illustrating the operation of the stacking delivery module in the embodiment of the present invention.

In an initial state, the holder assembly 150 is on the rightmost side in FIG. 22. The detective piece 193 is sensed by the sensors 195, so that the initial state is set up. At this time, the front ends of the upper holder 157 and the lower holder 161 contact with each other as shown in FIG. 15. That is, since the cam portion 155 of the bushing cam 154 installed on the motor shaft 153' faces the upper surface of the holder tray 152, the front ends of the upper holder 157 and the lower holder 161 contact with each other by means of the elastic force of the elastic member 166.

However, if the media are positioned on the moving path of the holder assembly 150 by means of the clamp housing 130, the holder assembly 150 moves to a position corresponding thereto. The holder assembly 150 is moved by the tray motor 170.

That is, the driving force of the tray motor 170 is transferred through the driving gear 172, the driven gear 173, and the driving pulley 174 to the timing belts 175, and the holder tray 152 connected through the belt holders 190 to the timing belts 175 moves, so that the holder assembly 150 moves.

The holder assembly 150 stops after moving to the sensor 195, the second from the right in FIG. 22. At this time, the front ends of the upper holder 157 and the lower holder 161 of the holder assembly 150 are separated from each other. Such a state is accomplished by the cam portion 155 of the bushing cam 154, which pushes a portion of the upper holder 157 by driving the holder motor 153.

Figure 23:
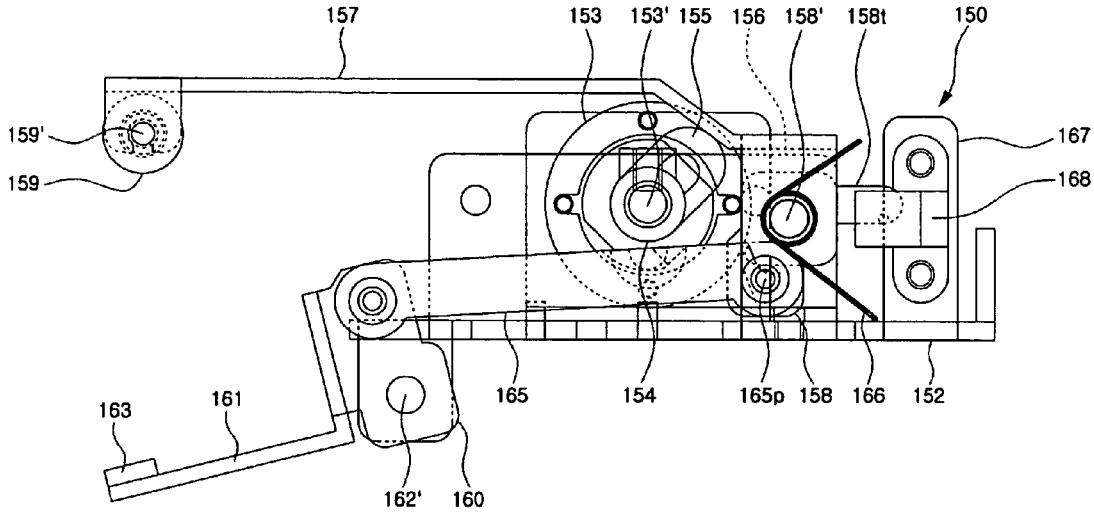
FIG. 23 is an operational state view illustrating the operation of the holder assembly in the embodiment of the present invention.

If the upper holder 157 overcomes the elastic force of the elastic member 166 by the bushing cam 154 and rotates about the hinge pin 158', the connecting link 165 connected to a side of the connecting pieces 158 through the pin 165*p* causes the front end of the lower holder 161 to rotate about the hinge pin 162'. Thus, the front end of the upper holder 157 and the lower holder 161 get separated from each other, as shown in FIG. 23.

Therefore, with the front ends of the upper holder 157 and the lower holder 161 separated from each other, when the holder assembly 150 moves toward the media, the media are positioned between the upper holder 157 and the lower holder 161. Then, if the holder motor 153 continues driving the bushing cam 154 to rotate, so that the cam portion 155 stops pushing the upper holder 157, the front ends of the upper holder 157 and the lower holder 161 come into contact with each other and then clamp the media. At this time, the media are positioned between the frictional members 159 and 163.

Next, the tray motor 170 again drives the holder assembly 150 to move. The holder assembly 150 moves in the left direction in FIG. 22. While the holder assembly 150 moves, if the detective piece 193 is sensed by the sensor 195, the third from the right, a door begins to open. The door, (not shown in the drawings), is provided in the cabinet of the media dispenser for dispensing the media to the customer.

When the holder assembly 150 continues to move and then is sensed by the sensor 195 on the leftmost side of the tray frame 30, the tray motor 170 stops. In such a state, the customer can take the media clamped by the upper holder 157 and the lower holder 161 of the holder assembly 150.

Since the media are compressed by the elastic force of the elastic member 166, which causes the front ends of the upper holder 157 and the lower holder 161 to contact with each other, the volume of the media is relatively minimized.

If the customer takes the media, the holder assembly 150 returns to its initial position. The clamp housing 130 also returns to its original position, and then gets ready to receive the next media to be dispensed.

Figure 20B:
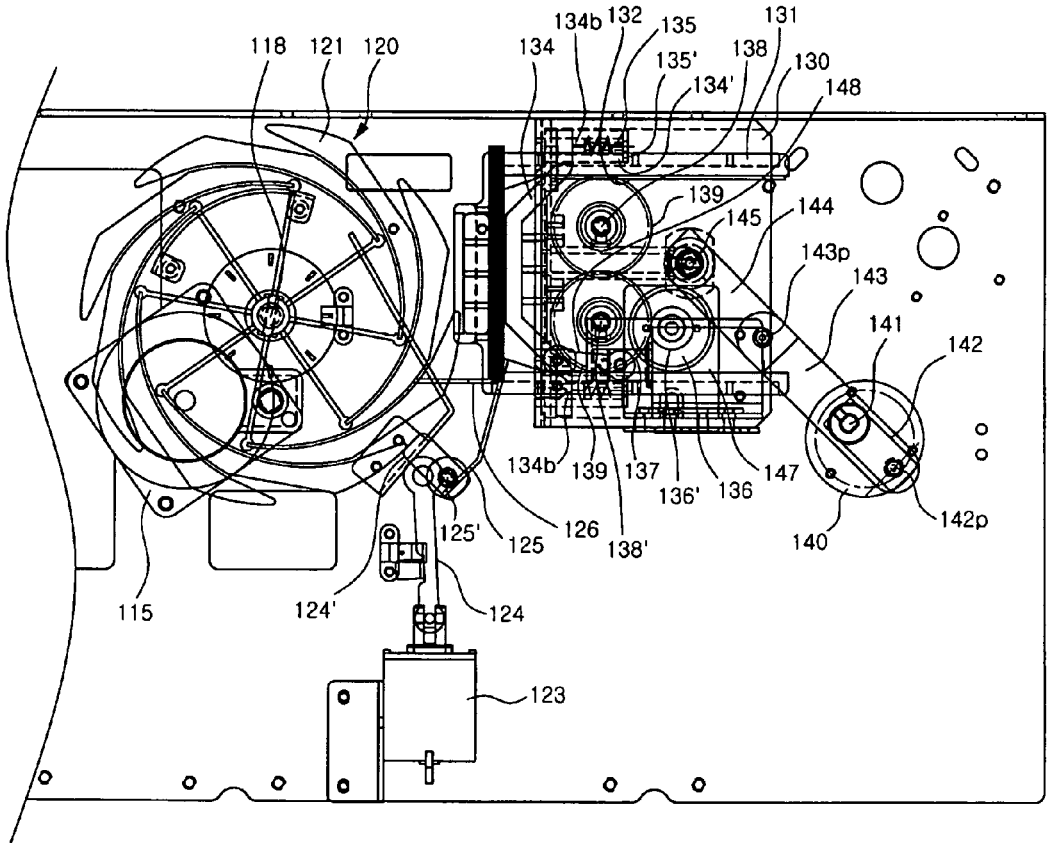
Figure 20C:
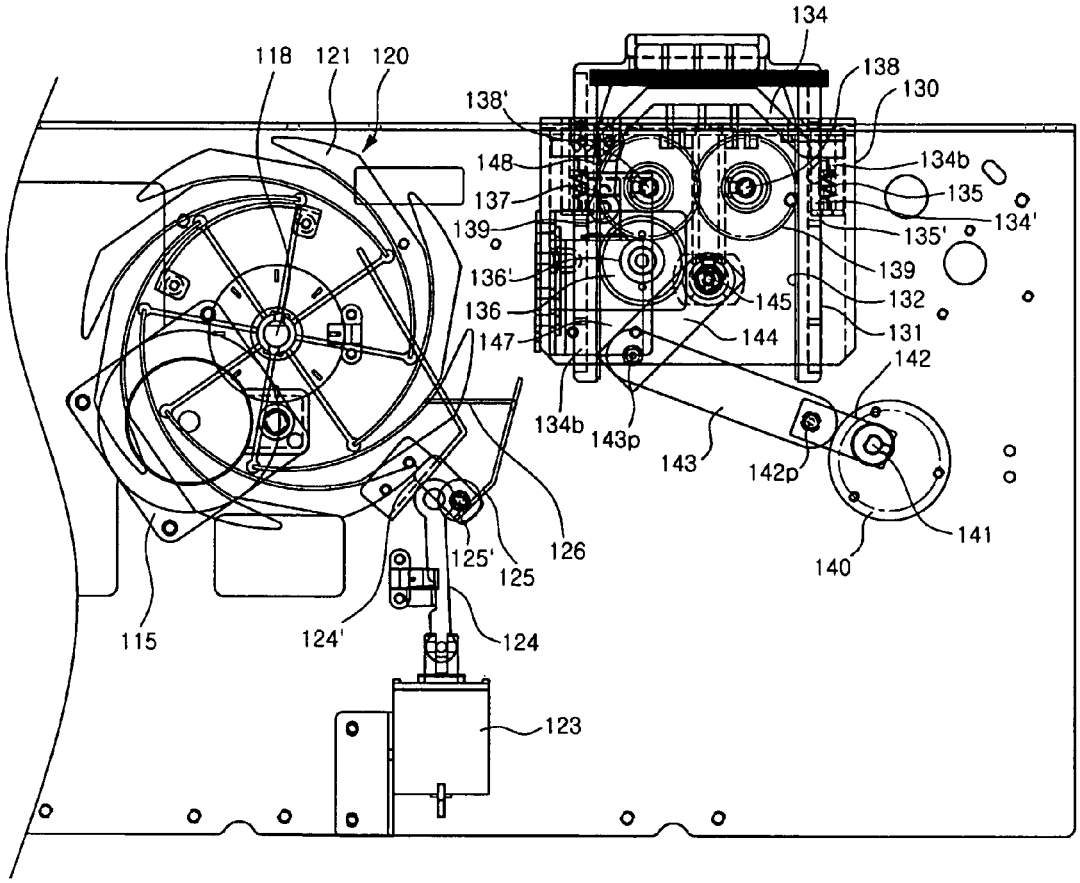

If the customer does not take the media clamped by the holder assembly 150, the media are rejected. That is, if the customer forgets to take the media clamped by the upper holder 157 and the lower holder 161 of the holder assembly 150, the holder assembly 150 moves to the initial position of the tray frame 30, and then the clamp housing 130 rotates into the state as shown in FIG. 20*c*.

Then, the clamp arms 131 are projected from the clamp housing 130, so that the media clamped by the upper holder 157 and the lower holder 161 of the holder assembly 150 are positioned between the front surface of the clamp housing 130 and the clamping plates 133. Next, the clamping plates 133 move toward the front surface of the clamp housing 130, so that the media are clamped between the clamping plates 133 and the elastic plates 134 of the clamp housing 130. Then, the holder assembly 150 moves to its initial position with the front ends of the upper holder 157 and the lower holder 161 separated from each other.

Figure 24:
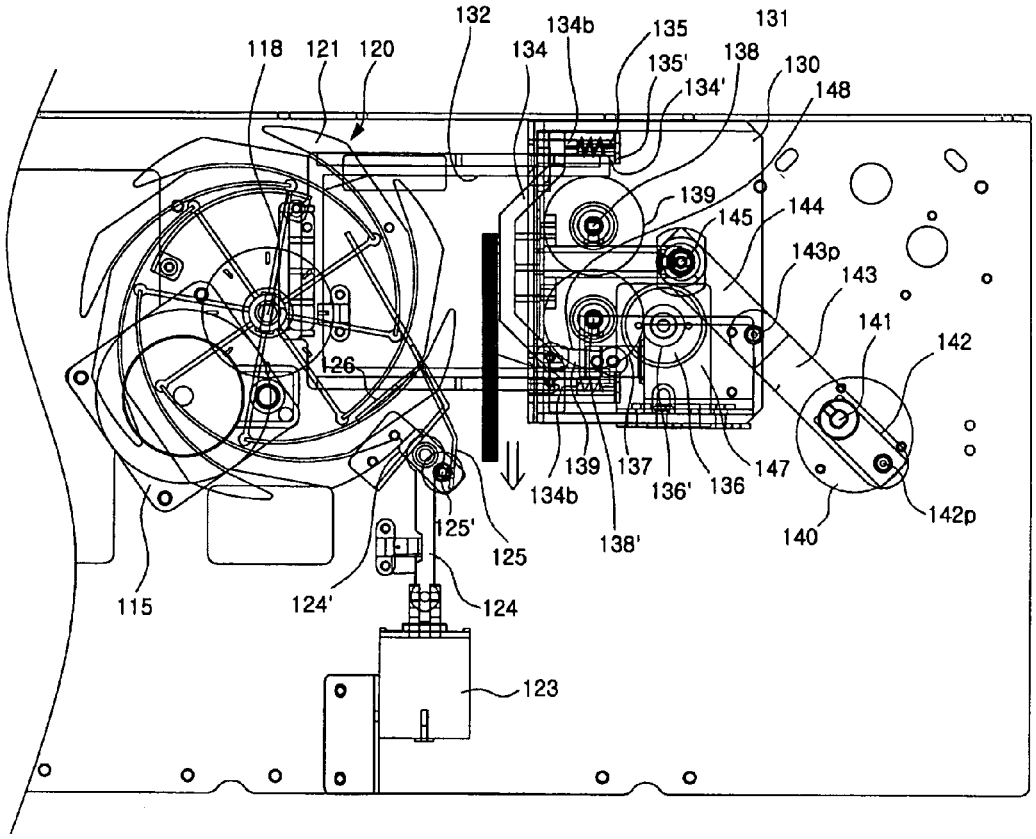
FIG. 24 is an operational state view illustrating the operation of structural features for rejecting the media in the embodiment of the present invention.

In such a state, the clamp housing 130 is rotated into the state shown in FIG. 24. FIG. 24 and FIG. 20*b* show the same state of the clamp housing 130. However, FIG. 24 shows that the stackers 125 rotate counterclockwise. Therefore, the clamping plates 133 and the clamp arms 131 project forward from the clamp housing 130, so that the media, closely contact with each other between the clamping plates 133 and the elastic plates 134 of the clamp housing 130, freely fall in the direction of an arrow shown in FIG. 24, and then are rejected into a reject box (not shown).

Then, the damper plate 146 rotates about the rotational center 146' by the damper solenoid 147, gets into the state shown in FIG. 9, and waits for the next media to be stacked. Of course, the stackers 125 also returned to an initial state so that the media are stacked thereon.

The functional effects of the present invention, as described above, are explained as follows. In the present invention, the delivery module 1, the stacking module 3 and the stacking delivery module 5 are provided in the second guide plates 20, 20', the first guide plates 10, 10' and the tray frame 30, respectively. Therefore, the delivery module 1, the stacking module 3 and stacking delivery module 5 are easily separated, so that the maintenance thereof is convenient.

In addition, even though the above modules are not separated in the media dispenser of the present invention, for example, the assembly including the first media guides 68, the assembly including the fourth media guides 87, and the assembly including the fifth media guides 114 may be configured so as to pivot on certain shafts, respectively. Thus, even if the media are jammed in the feeding path, the media can be easily removed.

Furthermore, if the tray frame 30 of the stacking delivery module 5 is separated from the first guide plates 10,10' and then is mounted accordingly, the discharge direction of the media dispenser can be changes according to a desired design. Thus, a dispensing position where a customer takes the media from the media dispenser can be easily changed, so that the vending machine designer's various requirements can be satisfied.

In the present invention, the clamp housing 130, which is provided with the clamping plates 133 driven by the clamp arms 131, clamps the received stacked media, the number of which the customer requires, at one time and feeds them simultaneously. Therefore, the media can be easily handled, and particularly, securely rejected to a desired position. Due to such a characteristic, a position of the reject box can be freely designed, and the media, which are sensed as abnormal media in the delivery module 1 and rejected, and the media, which the customer does not take, can be stored at one time.

In addition, since the clamp housing 130 is provided with the elastic plates 134 corresponding to the clamping plates 133, the media can be fed with close contact to each other regardless of the number of the media. Therefore, the operational reliability of clamping and feeding the media clamped at one time is improved.

Furthermore, the present invention is configured to feed the media to the stacking delivery module 5 by rotating the clamp housing 130 by a predetermined angle. Therefore, the stacking delivery module 5 is freely arranged, so that the feeding path of the media can be variously designed.

Since the motor and a plurality of links are used in the normal and reverse rotation of the clamp housing 130, even though the motor rotates in a constant direction, the normal and reverse rotation are possible, so that the operational reliability of the clamp housing is relatively improved.

In the present invention, when the media are fed by using the timing belts 175 in the stacking delivery module 5, the detective piece 193 is integrally formed in the belt holders for connecting the timing belts 175 and the holder assembly clamping the media. The detective pieces 193 cause a feeding position of the media to be precisely determined, so that the operational reliability can be improved with the simple construction.

In addition, since the upper holder 157 and the lower holder 161 for clamping the media in the stacking delivery module contact with and are separated from each other, a smaller movement of the upper holder 157 can make the larger motion between the upper holder 157 and the lower holder 161, so that the operational reliability for clamping the media is improved.

Furthermore, in the present invention, the thickness of the media is sensed at two different positions at the same time. Therefore, the thickness of the media is precisely sensed, so that two or more media can be prevented from being fed. In particular, even when the media have different thicknesses at both ends, the media can be precisely fed one-by-one.

The scope of the present invention is not limited by the illustrated embodiment but defined by the appended claims. It will be apparent that those skilled in the art can make various modifications and changes within the scope of the invention defined by the claims.

What is claimed is:

1. A media dispensing unit comprising:

a delivery module selectively feeding single sheets of media from a media box:

a stacking module collecting the single sheets of media from said delivery module and stacking the single sheets; and a clamping module which clamps the stacked media sheets at said stacking module and feeds the stacked media sheets to a position where a customer can take the stacked media sheets, wherein said clamping module includes:

a clamp housing;

a first clamp arm projecting out of said clamp housing, and moveable toward a front surface of said clamp housing;

a second clamp arm projecting out of said clamp housing, and moveable toward said front surface of said clamp housing;

a first clamp plate proved at a distal end of said first clamp arm;

a second clamp plate proved at a distal end of said second clamp arm;

a first elastic plate provided on said front surface of said clamp housing, which cooperates with said first clamp plate when said first clamp arm is moved toward said front surface of said clamp housing to clamp a first portion of a stack of media; and a second elastic plate provided on said front surface of said clamp housing, which cooperates with said second clamp plate when said second clamp arm is moved toward said front surface of said clamp housing to clamp a second portion of a stack of media.

2. The media dispensing unit according to claim 1, further comprising:

a first pair of guide plates which are positioned in parallel with a predetermined spacing from each other, wherein said stacking module is provided between said first pair of guide plates;

a second pair of guide plates which are positioned in parallel with a predetermined spacing from each other, wherein said delivery module is provided between said second pair of guide plates; and a tray frame provided alongside said first pair of guide plates, wherein said clamping module is attached to said tray frame, and wherein said stacking module is detachable from said delivery module, and said clamping module is detachable from said stacking module.

3. The media dispensing unit according to claim 2, wherein:

mounting flanges are formed on both sides of said tray frame;

end flanges are formed on ends of said first pair of guide plates;

said end flanges and said mounting flanges are engaged to each other with fasteners;

said fasteners pass through aligned holes formed in said mounting flanges and said end flanges; and at least one hole of said aligned holes is elongated in shape, so as to permit adjustment in the alignment of the connection between said tray frame and said first pair of guide plates.

4. The media dispensing unit according to claim 1, further comprising:

a thickness sensing mechanism for sensing a thickness of a media sheet, provided on a portion of a feeding path for the media in said delivery module, wherein said thickness sensing mechanism includes a cooperating first sensing roller and first sensing bearing and a cooperating second sensing roller and second sensing bearing, wherein said first and second sensing rollers and first and second sensing bearings are provided at positions corresponding to at least two portions of the media, so that the thickness of the media is sensed at the at least two portions of the media substantially simultaneously by passing the media between the sensing rollers and the sensing bearings.

5. The media dispensing unit according to claim 4, wherein said thickness sensing mechanism further includes:

a sensor frame;

a first roller shaft connected to said sensor frame and supporting said first sensing roller so that said first sensing roller can rotate about an axis of said first roller shaft;

a second roller shaft connected to said sensor frame and supporting said second sensing roller so that said second sensing roller can rotate about an axis of said second roller shaft;

a first bearing holder rotatable supporting said first sensing bearing, wherein said first bearing holder is biased in a direction tending to bring said first sensing bearing into contact with said first sensing roller;

a second bearing holder rotatable supporting said second sensing bearing, wherein said second bearing holder is biased in a direction tending to bring said second sensing bearing into contact with said second sensing roller;

a first shielding plate connected to, or integral with, said first bearing holder;

a second shielding plate connected to, or integral with, said second bearing holder;

a first light sensitive device provided proximate said first light shielding plate, wherein movement of said first light shielding plate, caused by a thickness of a first portion of a passing sheet of media, results in said first light shielding plate influencing an intensity of light received by said first light sensitive device; and a second light sensitive device provided proximate said second light shielding plate, wherein movement of said second light shielding plate, caused by a thickness of a second portion of a passing sheet of media, results in said second light shielding plate influencing an intensity of light received by said second light sensitive device.

6. The media dispensing unit according to claim 5, wherein said sensor frame includes first and second chambers, said first chamber includes a first window facing to a second window, said first light sensitive device is provided on a side of said first window opposite said first chamber, a first light emitting device is provided on a side of said second window opposite said first chamber, and said first light shielding plate moves inside said first chamber to block light passage from said second window to said first window; and wherein said second chamber includes a third window facing to a fourth window, said second light sensitive device is provided on a side of said third window opposite said second chamber, a second light emitting device is provided on a side of said fourth window opposite said second chamber, and said second light shielding plate moves inside said second chamber to block light passage from said third window to said fourth window.

7. The media dispensing unit according to claim 1, further comprising:

a first pair of guide plates which are positioned in parallel with a predetermined spacing from each other, and wherein:

said stacking module includes a stacking wheel for receiving and holding the single sheets of media to form the stack of media sheets;

said stacking wheel is rotatable about a shaft supported between said first pair of guide plates;

said stacking wheel includes a plurality of tangential wings which receive the media therebetween from said delivery module; and said stacking wheel rotates to stack sheets of media between said tangential wings onto a stacking plate.

8. The media dispensing unit according to claim 7, wherein said stacking plate can be moved between a substantially horizontal position and a non-horizontal position by a first driving source, which is separate from a second driving source for rotating said stacking wheel.

9. The media dispensing unit according to claim 1, wherein said first elastic plate includes a first surface protruding from said front surface of said clamp housing and a first elastic member behind said first surface, and said second elastic plate is includes a second surface protruding from said front surface of said clamp housing and a second elastic member behind said second surface.

10. The media dispensing unit according to claim 1, wherein said clamping module further includes:

an arm driving motor provided in said clamp housing to move said first and second clamp arms, wherein said arm driving motor rotates pinion gears, which engage with first and second rack portions formed on said first and second clamp arms, respectively.

11. The media dispensing unit according to claim 1, further comprising:

a first pair of guide plates which are positioned in parallel with a predetermined spacing from each other, wherein said clamp housing is rotatable about a housing driving shaft supported between said first pair of guide plates; and a clamp driving mechanism for rotating said clamp housing a predetermined angle about said housing driving shaft.

12. The media dispensing unit according to claim 11, wherein said clamp driving mechanism includes:

a housing motor, which operates in one direction;

a driving link, which is connected to a rotational shaft of said housing motor to rotate integrally therewith;

a second connecting link, which is connected to said housing driving shaft to rotate integrally therewith; and a first connecting link, both ends of which are relatively rotatably connected to said driving link and said second connecting link by pins, respectively.

13. The media dispensing unit according to claim 1, wherein a damper plate is installed between said first and second elastic plates of said front surface of said clamp housing, and wherein an end of said damper plate is pivotably mounted with respect to said clamp housing away, such that said damper plate can pivot away from said front surface of said clamp housing by a predetermined angle.

14. The media dispensing unit according to claim 13, wherein said damper plate is selectively positioned between a first position where said damper plate is close to said front surface of said clamp housing and a second position where said damper plate is inclined toward said stacker module, and wherein said damper plate is moved to at least one of said first and second positions by the operation of a solenoid.

15. The media dispensing unit according to claim 1, wherein said delivery module includes:

a driving source;

at least one timing belt, which transfers a driving force of said driving source; and a holder assembly, which is connected to said at least one timing belt to move along a tray frame, and which clamps the stack of media fed from said stacking module and then feeds the stack of media to a position where the customer can take the stack of media.

16. The media dispensing unit according to claim 15, wherein said holder assembly, includes:

a holder tray, which is guided along side rails at both sides of said tray frame;

an upper holder and a lower holder, which are installed on said holder tray so as to clamp the stack media to be fed to the customer by an elastic force of an elastic member; and a holder motor, which provides a driving force in order for front ends of said upper holder and said lower holder to contact with or be separated from each other.

17. The media dispensing unit according to claim 16, wherein:

said holder motor includes a rotational shaft having a bushing cam;

said brushing cam has a cam portion projecting in a radial direction of a rotational center of said rotational shaft;

said bushing cam selectively contacts with one of said upper holder and said lower holder according to the rotation of said rotational shaft of said holder motor;and said upper holder and said lower holder are connected to each other by a connecting link so that said upper and lower holder operate substantially simultaneously.

18. The media dispensing unit according to claim 17, wherein at least one of said upper and lower holders has a detective piece associated therewith, and further comprising:

a sensor for detecting said detective piece, wherein said sensor provides data for operating said upper and lower holders.

19. The media dispensing unit according to claim 15, wherein a feeding position of said holder assembly is detected by sensing a position of a detective piece formed integrally with, or attached to, a belt holder connected to said timing belt or said holder assembly.

20. The media dispensing unit according to claim 19, wherein said detective piece is sensed by a plurality of sensors provided at at least an initial position and a final position of said holder assembly and a position before the final position, for signaling a time for opening a door, through which the customer takes the stack of media.

* * * * *